US010125493B2

(12) United States Patent
Palermo et al.

(10) Patent No.: US 10,125,493 B2
(45) Date of Patent: Nov. 13, 2018

(54) PRE-STRESSED BEAMS OR PANELS

(71) Applicant: UNIVERSITY OF CANTERBURY, Christchurch (NZ)

(72) Inventors: Alessandro Palermo, Christchurch (NZ); Stefano Pampanin, Christchurch (NZ)

(73) Assignee: University of Canterbury, Christchurch (NZ)

( * ) Notice: Subject to any disclaimer, the term of this patent is extended or adjusted under 35 U.S.C. 154(b) by 0 days.

(21) Appl. No.: 15/590,304

(22) Filed: May 9, 2017

(65) Prior Publication Data

US 2018/0058070 A1 Mar. 1, 2018

Related U.S. Application Data

(63) Continuation of application No. 14/888,679, filed as application No. PCT/NZ2014/000081 on May 6, 2014, now Pat. No. 9,809,979.

(Continued)

(51) Int. Cl.

*E04C 3/18* (2006.01)
*E04C 3/26* (2006.01)

(Continued)

(52) U.S. Cl.

CPC ..... *E04C 3/26* (2013.01); *E04B 1/06* (2013.01); *E04B 1/14* (2013.01); *E04B 1/22* (2013.01);

(Continued)

(58) Field of Classification Search

CPC ... E04C 3/26; E04C 3/292; E04C 3/12; E04C 3/18; E04C 5/12; E04C 5/08; E04C 1/40;

(Continued)

(56) References Cited

U.S. PATENT DOCUMENTS 3,495,367 A 2/1970 Kobayashi
3,810,337 A 5/1974 Pollard (Continued)

FOREIGN PATENT DOCUMENTS

DE 804036 4/1951
EP 0952271 10/1999

(Continued)

OTHER PUBLICATIONS

International Search Report for Application No. PCT/NZ2014/000081 dated Sep. 4, 2014 (5 pages).

(Continued)

*Primary Examiner* — Gisele D Ford

(74) *Attorney, Agent, or Firm* — Michael Best & Friedrich LLP

(57) ABSTRACT

A method of manufacturing a pre-stressed beam or panel and the resulting beam or panel are described. The method includes providing a timber-based component (1); providing a pre-stressing member (9) arranged along the timber-based component; applying a tensile force to the pre-stressing member (9); providing concrete anchors (11*a*, 11*b*) at locations that are spaced apart along the timber-based component (1); coupling the pre-stressing member (9) to the concrete anchors (11*a*, 11*b*); and releasing the tensile force on the pre-stressing member (9) to transfer a compressive force to the timber-based component (1) through the concrete anchors (11*a*, 11*b*) to form a pre-stressed beam or panel.

29 Claims, 32 Drawing Sheets

Related U.S. Application Data

(60) Provisional application No. 61/819,724, filed on May 6, 2013.

(51) Int. Cl.

| | |
|---|---|
| ***E04B 5/12*** | (2006.01) |
| ***E04C 1/40*** | (2006.01) |
| ***E04C 2/10*** | (2006.01) |
| ***E04C 2/26*** | (2006.01) |
| ***E04C 2/38*** | (2006.01) |
| ***E04C 2/42*** | (2006.01) |
| ***E04C 3/29*** | (2006.01) |
| ***E04B 5/23*** | (2006.01) |
| ***E04B 1/06*** | (2006.01) |
| ***E04B 1/14*** | (2006.01) |
| ***E04B 1/22*** | (2006.01) |
| ***E04B 1/30*** | (2006.01) |
| ***E04C 2/28*** | (2006.01) |
| ***E04C 5/12*** | (2006.01) |
| *E04C 5/08* | (2006.01) |
| *E04B 5/04* | (2006.01) |

(52) U.S. Cl.

CPC ..... *E04B 1/30* (2013.01); *E04B 5/12* (2013.01); *E04B 5/23* (2013.01); *E04C 1/40* (2013.01); *E04C 2/10* (2013.01); *E04C 2/26* (2013.01); *E04C 2/28* (2013.01); *E04C 2/38* (2013.01); *E04C 2/42* (2013.01); *E04C 3/29* (2013.01); *E04C 5/12* (2013.01); *E04B 5/04* (2013.01); *E04B 2005/232* (2013.01); *E04C 3/18* (2013.01); *E04C 5/08* (2013.01)

(58) Field of Classification Search

CPC ... E04C 3/29; E04C 2/26; E04C 3/293; E04H 12/04; E04B 5/23

See application file for complete search history.

(56) References Cited

U.S. PATENT DOCUMENTS

| | | | |
|---|---|---|---|
| 3,882,651 | A | 5/1975 | Gilchrist |
| 4,442,149 | A | 4/1984 | Bennett |
| 4,619,088 | A | 10/1986 | Ripoll Garcia-Mansilla |
| 5,079,879 | A | 1/1992 | Rodriguez |
| 5,089,713 | A | 2/1992 | Vala et al. |
| 5,097,558 | A | 3/1992 | Accorsi et al. |
| 5,125,200 | A | 6/1992 | Natterer |
| 5,263,291 | A | 11/1993 | Knight |
| 5,493,828 | A | 2/1996 | Rogowsky et al. |
| 5,749,185 | A | 5/1998 | Sorkin |
| 5,809,713 | A | 9/1998 | Ray |
| 5,881,514 | A | 3/1999 | Pryor |
| 6,105,321 | A | 8/2000 | KarisAllen et al. |
| 6,151,844 | A | 11/2000 | Kovachevich |
| 6,170,209 | B1 | 1/2001 | Dagher et al. |
| 6,223,487 | B1 | 5/2001 | Dinkel |
| 7,197,854 | B2 | 4/2007 | Bettigole et al. |
| 7,852,675 | B2 | 12/2010 | Maejima |
| 8,925,266 | B2 | 1/2015 | Stubler et al. |
| 2004/0065030 | A1 | 4/2004 | Zambelli et al. |
| 2004/0221533 | A1 | 11/2004 | Tokuno et al. |
| 2005/0086906 | A1 | 4/2005 | Bathon et al. |
| 2005/0188644 | A1 | 9/2005 | Moure |
| 2007/0175583 | A1 | 8/2007 | Mosallam |
| 2012/0124796 | A1 | 5/2012 | Ibanez Ceba |
| 2012/0282025 | A1 | 11/2012 | French |
| 2012/0317905 | A1 | 12/2012 | MacDuff |
| 2013/0174503 | A1 | 7/2013 | Olson et al. |
| 2013/0239512 | A1 | 9/2013 | Yang |
| 2014/0090317 | A1 | 4/2014 | Nakashima et al. |

FOREIGN PATENT DOCUMENTS

| | | |
|---|---|---|
| EP | 1528171 | 5/2005 |
| FR | 2316393 | 1/1977 |
| JP | 05-331959 | 12/1993 |
| JP | 10-176385 | 3/1998 |
| JP | 2005144747 | 6/2005 |
| JP | 2009-228361 | 10/2009 |
| WO | 1998040192 | 9/1998 |
| WO | 2004097138 | 11/2004 |
| WO | 2004098876 | 11/2004 |

OTHER PUBLICATIONS

Written Opinion for Application No. PCT/NZ2014/0000081 dated Sep. 4, 2014 (7 pages).

Yeoh, D., Fragiacomo, M., Banks, W., and Newcombe, M. P. (2009). "Design and Construction of a LVL-concrete Composite Floor." ICE Journal Structures and Building—Timber Special Issue.

Smith, J et al—Design and Construction of Prestressed Timber Buildings for Seismic Areas, Department of Civil Engineering University of Canterbury, Christchurch, New Zealand (undated).

Cristini, T., Palermo, A., Crews, K., Shrestha, R., and Buchanan, A. H. (2011). "Benefits of Londitudinal Post-tensioning in Timber Slabs." Structural Engineering World Congress, Lake Como, Italy.

Buchanan, A., Deam, B., Fragiacomo, M., Pampanin, S., and Palermo, A. (2008). "Multi-Storey Prestressed Timber Buildings in New Zealand." Journal of the International Association for Bridge and Structural Engineering, 18(2), 166-173.

Buchanan, A. H., Pampanin, S., Newcombe, M., and Palermo, A. (2009). "Non-Conventional Multi-storey Timber Buildings using Post-tensioning." 11th International Conference on Non-conventional Materials and Technologies, Bath, UK.

Buchanan, A. H., Palermo, A. Carradine, D., and Pampanin, S. (2011). "Post-tensioned Timber Frame Buildings." The Structural Engineer.

Dal Lago, B. A., and Dibenedetto, C. (2009). "Use of Longitudinal Unbonded Post-Tensioning in Multi-Storey Timber Buildings," Politecnico di Milano, Milan, Italy.

Palermo, A., Pampanin, S., Carradine, D., Buchanan, A. H., Lago, B. D., Dibenedetto, C., Giorgini, S., and Ronna, P. (2010). "Enhanced Performance of Longitudinally Posttensioned Long-span LVL Beams." 11th World Conference on Timber Engineering, Riva del Garda, Trentino, Italy, 11.

van Beerschoten, W., Palermo, A., Carradine, D., Sarti, F., and Buchanan, A. (2011a). "Experimental Investigation on the Stiffness on Beam-Column Connections in Post-Tensioned Timber Frames." Structural Engineering World Congress, Lake Como, Italy.

van Beerschoten, W., Smith, T., Palermo, A., Pampanin, S., and Ponzo, F. C. (2011b) "The Stiffness of Beam to Column Connection in Post-Tensioned Timber Frames." CIB W18 Workshop on Timber Structures, Alghero, Italy.

Sarti, F. (2010). "Simplified Design Methods for Post-tensioned Timber Buildings," Politecnico di Milano, Milan, Italy.

van Beerschoten, W., Palermo, A., and Carradine, D. (2012). "Gravity Design of Post-Tensioned Timber Frames for Multi-Storey Buildings." ASCE/SEI Structures Congress, Chicago, USA.

van Beerschoten, W. A., Palermo, A., and Carradine, D. (2012). "Unbonded Post-tensioned Timber Gravity Frames for Multi-Storey Buildings." Australasian Structural Engineering Conference, Perth, Australia.

van Beershoten, W., Palermo, A., Carradine, D., and Pampanin, S. (2012). "Design Procedure for Long-Span Post-tensioned Timber Frames Under Gravity Loading." 12th World Conference on Timber Engineering, Auckland, New Zealand.

van Beerschoten, W. (2013). "Structural Performance of Post-tensioned Timber Frames under Gravity Loading," University of Canterbury, Christchurch, New Zealand.

Fragiacomo, M., and Deam, B. L. (2006). "Composite Concrete Slab and LVL Flooring Systems." 19th Australasian Conference on Mechanics of Structures and Materials Christchurch, New Zealand, 57-62.

(56) References Cited

OTHER PUBLICATIONS

Davies, M. (2007). "Long Term Behaviour of Laminated Veneer Lumber (LVL) Members Prestressed with Unbonded Tendons," University of Canterbury, Christchurch, New Zealand.
Davies, M., and Fragiacomo, M. (2008). "Long-Term Behaviour of Laminated Veneer Lumber Members Prestressed with Unbonded Tendons." New Zealand Timber Design Journal, 16(3), 13-20.
Neale, A. (2009). "Long Term Performance of Post-Tensioned Timber Buildings," University of Canterbury, Christchurch, New Zealand.
Giorgini, S., Neale, A., Palermo, A., Carradine, D., Pampanin, S., and Buchanan, A.H. (2010). "Predicting Time Dependent Effects in Unbonded Post-tensioned Timber Beams and Frames." CIB W18 Workshop on Timber Structures, Nelson, New Zealand.

PRE-STRESSED BEAMS OR PANELS

FIELD OF THE INVENTION

This invention relates to a pre-stressed beam or panel and to a method of manufacturing a pre-stressed beam or panel.

BACKGROUND

Traditional pre-stressed concrete hollow-core planks are used in the construction of buildings and bridges. While concrete-based construction members are strong and low cost, they are also heavy, expensive to transport and have a high associated environmental cost.

Timber has many advantages over concrete; it has higher strength to weight, is a renewable resource, and wood-based members generally perform better during seismic events due to their reduced mass. Timber is often considered more aesthetically pleasing than concrete and therefore is less likely to necessitate painting or cladding. Despite these advantages, engineered timber structural members are used less often than concrete in large commercial building. This is due to the higher cost of timber and because the on-site construction process is often more complex than for concrete members.

Concrete construction members are available as pre-fabricated and pre-stressed lengths, whereas timber members normally require post-tensioning on site. That requires special skills and equipment and slows construction time.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide a pre-stressed beam or panel, and a method for manufacturing a pre-stressed beam or panel that addresses the above mentioned problems and/or that at least provides the public with a useful alternative.

SUMMARY OF THE INVENTION

In a first aspect, the invention provides a method of manufacturing a pre-stressed beam or panel. The method comprises: providing a timber-based component; providing a pre-stressing member arranged along the timber-based component; applying a tensile force to the pre-stressing member; providing concrete anchors at locations that are spaced apart along the timber-based component; coupling the pre-stressing member to the concrete anchors; and releasing the tensile force on the pre-stressing member to transfer a compressive force to the timber-based component through the concrete anchors to form a pre-stressed beam or panel.

In a preferred embodiment, the concrete anchors are provided by pouring concrete at locations that are spaced apart along the timber-based component, embedding respective portions of the pre-stressing member. Coupling the pre-stressing member to the anchors comprises allowing the concrete to substantially cure, before the tensile force on the pre-stressing member is released.

Preferably, the concrete is poured at two spaced apart locations positioned at or adjacent the ends of the timber-based component to form end anchors.

In an alternative embodiment, the concrete anchors are pre-cast. The pre-stressing members may be coupled to the pre-cast anchors by grouting, concrete, or mechanical fasteners, for example.

In a preferred embodiment, the method comprises providing and tensioning a plurality of pre-stressing members.

In one embodiment the method comprises pouring concrete at one or more locations between the two end anchors to form one or more intermediate concrete anchors embedding a respective intermediate portion of the pre-stressing member;

allowing the or each intermediate concrete anchor to substantially cure; and cutting the beam or panel through the or each intermediate anchor and through the respective anchored intermediate portion of the pre-stressing member to form two or more shorter pre-stressed beams or panels. Alternatively, the method may comprise placing at least three discrete pre-cast anchors at spaced apart locations and coupling the pre-stressing member to each of the at least three pre-cast anchors using concrete or grouting. Preferably these three anchors comprise two end anchors and an intermediate anchor positioned between the two end anchors. Once the concrete or grouting has substantially cured, the pre-stressed beam or panel may be cut through the intermediate anchor and through the respective anchored portion of the pre-stressing member, to form two shorter pre-stressed beams or panels.

Using this method, a plurality of shorter pre-fabricated pre-stressed beams or panels, suitable for transport to a construction site, may be pre-stressed at one time.

Some embodiments may comprise pouring or placing two or more intermediate anchors between the end anchors, and cutting the pre-stressed beam or panel through each intermediate anchor.

Preferred forms of the method may be carried out in existing yards currently used for producing precast concrete, with only minor modifications to the yards and equipment. Equipment such as pre-stressing jacks may be used to apply tensile force to the pre-stressing member(s). The tension may be maintained in the pre-stressing member(s) while the concrete cures using any known suitable method.

The pre-stressing member(s) may consist of one or more tendons, which may be rods, bars or cables, for example, or alternatively may consist of one or more plate or sheet members, and could for example be laminates. Preferably the pre-stressing member(s) comprise high tensile steel, but alternatively they may comprise an alloy, carbon composite, glass-aramid, or other composite material.

The timber-based component is preferably an elongate member with one or more elongate hollow portion(s) or channel(s) to receive at least a portion of the pre-stressing member(s). The pre-stressing member(s) may be inserted in a respective hollow portion(s) or channel(s) of the completed timber-based component, for example by being placed in channel(s) extending along an outer surface of the timber-based component. Alternatively the pre-stressing member(s) may be inserted in a respective hollow portion(s) or channel(s) during assembly of the timber-based component, for example by being placed in a channel that is subsequently covered by a timber member such that at least a part of the pre-stressing member(s) is enclosed by the timber-based component.

In one embodiment, the concrete for the anchors is poured into hollows or boxed regions defined by the timber-based component. In an embodiment having three or more anchors, in which the initial beam or panel is cut into a plurality of shorter beams or panels, the timber-based component is preferably sufficiently elongate that the plurality of shorter beams or panels are also elongate.

The timber-based component may be a single integrally formed member or may comprise a plurality of members or sub-components assembled or arranged together.

The timber sub-components may be arranged, for example, end-to-end, but not connected. Alternatively, the sub-components may be connected. In that embodiment, the pre-stressing member is arranged to extend along all of the individual sub-components, and the or each intermediate concrete anchor is poured between the ends of two adjacent individual sub-components to join the sub-components. The intermediate concrete anchor(s) may then be cut to separate the beam or panel into shorter beams or panels.

The timber-based component may further comprise a transverse channel or hollow portion for receiving a transverse pre-stressing member for pre-stressing the beam or panel in a second transverse direction. The transverse pre-stressing member may be one of the type described above, and may be the same or different from the longitudinal pre-stressing member(s).

In one such embodiment, the method further comprises inserting a transverse pre-stressing member into the transverse channel or hollow portion, applying a tensile force to the transverse pre-stressing member, pouring concrete at spaced apart locations along the transverse pre-stressing member, allowing the concrete to substantially cure to anchor respective portions of the transverse pre-stressing member, and releasing the tension from the transverse pre-stressing member to pre-stress the beam or panel in the transverse direction. These steps to pre-stress the beam or panel in the second direction may be carried out on the pre-fabricated beam or panel, after the beam or panel has been pre-stressed in the first direction, and optionally after the initial beam or panel is cut into shorter lengths. Alternatively, the beam or panel may be pre-stressed in the second direction at the same time it is pre-stressed in the first direction.

In an alternative embodiment pre-stressed in a transverse direction, the method may further comprise coupling pre-cast anchors at spaced apart locations along the transverse pre-stressing member, inserting transverse pre-stressing member into the transverse channel or hollow portion, applying a tensile force to the transverse pre-stressing member, coupling the tensioned pre-stressing members to the pre-cast anchors, and releasing the tension from the transverse pre-stressing member to pre-stress the beam or panel in the transverse direction. The pre-stressing member may be coupled to the pre-cast anchors by grouting, concrete, or by mechanical fasteners.

In an embodiment, the timber-based component comprises an engineered timber laminate such as LVL (laminated veneer lumber), glulam (glued laminated timber), or Cross-lam/CLT (cross laminated timber). Alternatively or additionally, the timber-based component may comprise a wood-based composite, for example manufactured by binding strands, particles or veneers of wood together with adhesive to form a composite, and/or sawn hard wood. The timber-based component may also comprise one or more other structural materials such as steel, composite carbon fibre reinforcement, or glass reinforcing members. As one example, a timber-based component having one or more webs may comprise composite CFRP (carbon fibre reinforced polymers), GFRP (glass fibre reinforced polymers), or steel reinforcing in the webs.

The timber-based component may also comprise a concrete topping layer on a top side of the timber-based component, for fire, seismic, acoustic and/or vibration performance, for example. The concrete topping layer may be reinforced, for example with steel or mesh reinforcing and may be prefabricated or poured in-situ or at the same time as the concrete anchors. The topping layer may be bonded to the timber-based components, so to contribute to the strength of the beam or panel. In one embodiment, the concrete topping layer is bonded to the timber-based component by way of fasteners protruding from a top side of the timber-based component. The fasteners become at least partly embedded in the concrete when the topping layer is poured. Alternatively the topping layer may be unbonded from the timber-based component.

The timber-based component may further comprise a transverse channel or hollow portion for receiving a transverse pre-stressing member. In such an embodiment, the timber-based component may comprise cross laminated timber. In such embodiments, the method may comprise inserting a transverse pre-stressing member into the transverse channel or hollow portion; applying a tensile force to the transverse pre-stressing member; pouring concrete at spaced apart locations along the transverse pre-stressing member; allowing the concrete to substantially cure to anchor respective portions of the transverse pre-stressing member; and releasing the tension from the transverse pre-stressing member to pre-stress the beam or panel in the transverse direction.

Alternatively the method may comprise attaching pre-cast anchors to the timber-based component at spaced apart locations along the transverse channel or hollow portion; inserting a transverse pre-stressing member into the transverse channel or hollow portion; applying a tensile force to the transverse pre-stressing member; coupling the tensioned transverse pre-stressing member to the respective pre-cast anchor; and releasing the tension from the transverse pre-stressing member to pre-stress the beam or panel in the transverse direction.

A plurality of pre-fabricated beams that have been pre-stressed in the first longitudinal direction may be placed side-by-side and pre-stressed in the second direction together to form a panel member. This step may be carried out on a construction site. For example, a plurality of pre-fabricated pre-stressed beams each comprising a transverse channel or hollow portion may be placed side-by-side so the channels or hollow portions on the beams are aligned, and the transverse pre-stressing member arranged to extend through the transverse channels or hollow portions in the plurality of side-by-side beams.

In one embodiment, two side members each comprising a transverse opening aligned with the transverse channels or hollows may be placed one on either side of the plurality of side-by-side beams. Concrete is poured into the transverse opening in each side member to form the anchors for the transverse pre-stressing member. Alternatively, pre-cast anchors may be attached to opposite sides of the timber component and the transverse pre-stressing member tensioned and coupled to those pre-fabricated anchors. The pre-stressing member may be coupled to the pre-cast anchors by grouting, concrete, or mechanical fasteners.

The concrete anchors may be made from light weight concrete, or may comprise hollow regions or timber cores to reduce weight. The method may comprise placing timber, polystyrene or other filler material at the location for each anchor, before pouring the concrete, to create a lightweight core, region, or void in the anchors.

The concrete anchors may comprise steel reinforcing, for example stirrups and bars. For example, the method may comprise placing one or more steel reinforcing members at the location for each anchor, before pouring the concrete, to reinforce the concrete anchors.

In embodiments in which the concrete anchors are poured, shear or axial connectors may protrude from part of the timber-based component into one or more of the anchor locations, such that the connectors become at least partly embedded in the concrete anchors when the anchors are poured. The concrete then cures around the connectors, strengthening the connection between the anchors and the timber-based component.

In a second aspect, the invention provides a pre-stressed beam or panel manufactured according to the method outlined in relation to the first aspect above.

In a third aspect, the invention provides a pre-fabricated pre-stressed beam or panel comprising: a timber-based component; spaced apart concrete anchors operatively connected to the timber-based component; and at least one pre-stressing member extending between the spaced apart concrete anchors. The pre-stressing member comprises portions coupled to the concrete anchors to apply a compressive force to the timber-based component to pre-stress the beam or panel.

The concrete anchors are preferably discrete anchors and preferably comprise two end anchors recessed in opposite ends of the timber-based component. The beam or panel may comprise one or more intermediate anchors positioned between the two end anchors. The intermediate anchors preferably have a length about twice the length of the end anchors.

The beam or panel may comprise one or a plurality of pre-stressing members. The pre-stressing member(s) may consist of one or more tendons, which may be rods, bars or cables, for example, or alternatively may consist of one or more plate or sheet member(s), and could for example be laminates. Preferably the pre-stressing members comprise high tensile steel, but alternatively may comprise an alloy, carbon composite, or glass-aramid or other composite material, for example.

The pre-stressing member(s) preferably comprise portions embedded in the discrete anchors.

The timber-based component is preferably an elongate member with one or more elongate hollow portion(s) or channel(s) to receive the pre-stressing member(s). The pre-stressing member(s) may be positioned in the hollow portion(s) or channel(s) of the timber-based component, for example they may be positioned in channel(s) extending along an outer surface of the component or within internal hollow portion(s) in the timber-based component such that at least a portion of the pre-stressing member(s) are enclosed by the component. The timber component may comprise a transverse wall adjacent each anchor, the wall comprising one or more apertures through which the pre-stressing member(s) extend. Preferably, the cross sectional area of each concrete anchors is much larger than the cross sectional area of the channel, hollow or wall aperture(s) immediately adjacent the anchor. For example, the cross sectional area of each concrete anchors may be at least twice or at least three times the cross sectional area of the channel, hollow or wall aperture(s) immediately adjacent the anchor.

In an embodiment having three or more anchors, the timber-based component is preferably sufficiently elongate that a plurality of shorter beams or panels that are also elongate may be formed by cutting through the intermediate anchor(s). The timber-based component may comprise a plurality of individual timber-based sub-components arranged end-to-end. In such an embodiment, the pre-stressing member(s) may extend along all of the individual sub-components, and the intermediate concrete anchor(s) are positioned between the ends of two adjacent individual sub-components connecting the sub-components.

In one embodiment, the timber-based component comprises an engineered timber laminate, a wood-based composite and/or sawn hard wood, and may comprise other structural materials or topping layers, as described with above with respect to the first aspect.

For example, one embodiment comprises a concrete topping layer on a top side of the timber-based component. The beam or panel may further comprise fasteners attached to the top side of the timber-based component and at least partly embedded in the concrete topping layer. The topping layer may comprise steel or mesh reinforcing.

The timber-based component may further comprise a transverse channel or hollow portion for receipt of a transverse pre-stressing member. Spaced apart transverse concrete anchors may be operatively connected to the timber-based component. In one such embodiment, the beam or panel further comprises spaced apart transverse concrete anchors and a transverse pre-stressing member arranged in the transverse channel or hollow portion and extending between the transverse concrete anchors, applying a compressive force to the timber-based component to pre-stress the beam or panel in the transverse direction. The transverse pre-stressing member may be one of the type described above, and may be the same or different from the longitudinal pre-stressing member(s).

The beam or panel may comprise a plurality of the above beams each comprising a transverse channel or hollow portion arranged side-by-side with the channels or hollow portions aligned and further comprising two side members, one on either side of the plurality of side-by-side beams. In such an embodiment, the side members each comprise a concrete anchor aligned with the transverse channels or hollows, and a transverse pre-stressing member arranged in the transverse channels or hollow portions and extending between the transverse concrete anchors, such that the transverse pre-stressing member pre-stresses the beam or panel in the transverse direction.

The concrete anchors may be made from a light weight concrete, or may comprise hollow regions or timber cores to reduce weight.

In some embodiments, the beam or panel comprises shear and/or axial connectors that protrude from the timber-based component into one or more of the anchor regions, such that the shear connectors are at least partly embedded in the concrete anchors. This strengthens the connection between the anchors and the timber-based component. The shear and/or axial connectors may comprise timber-based protrusions on the or each timber-based component. Alternatively, the timber-based component may comprise recesses in the anchor regions, such that the concrete anchors protrude into the recesses to strengthen the connection between the anchors and the timber-based component.

One embodiment beam or panel comprises: a plurality of side-by-side timber-based components; spaced apart transverse concrete anchors; and a transverse pre-stressing member extending between the transverse concrete anchors and coupled to the transverse concrete anchors, the transverse pre-stressing member applying a compressive force to the timber-based component to pre-stress the beam or panel in the transverse direction.

In one embodiment, the anchors are at least partly pre-cast. The pre-cast anchors may comprise attachment features and the timber-based component may comprise a series of complementary attachment features for attaching the anchors to the timber-based component. In one embodiment the attachment features on the anchors comprise a plurality of protruding rods, bars, or screws, and the attachment features on the timber-based component comprise a plurality of complementary holes for receiving the rods, bars, or screws. Alternatively the timber-based component may comprise protruding rods, bars, or screws, and the anchors may comprise a plurality of complementary holes. The holes may contain epoxy, grouting, concrete, or an adhesive to improve the connection between the anchors and the timber-based component.

In one embodiment the anchors are partly pre-cast and each comprise a duct that receives the pre-stressing member. The duct comprises concrete or grouting, coupling the pre-stressing member to the anchors. In an alternative embodiment, the anchors are pre-cast and the pre-stressed beam or panel comprises mechanical fasteners that mechanically couple the pre-stressing member to the anchors.

In a fourth aspect, the invention provides a method of manufacturing a panel. The method comprises placing a plurality of pre-fabricated beams or panels as outlined in relation to the second or third aspects of the invention, side-by-side. The method further comprises providing a transverse pre-stressing member arranged transversely across the side-by-side timber-based components, applying a tensile force to the transverse pre-stressing member, providing transversely spaced concrete anchors, coupling the transverse pre-stressing member to the transversely spaced concrete anchors, and releasing the tensile force on the transverse pre-stressing member to transfer a transverse compressive force to the timber-based components through the transverse concrete anchors to pre-stress the panel in the transverse direction.

Each pre-fabricated beam or panel may comprise a transverse channel or hollow portion, the pre-fabricated beams or panels being arranged side-by-side so the channels or hollow portions of the beams are aligned. In such an embodiment, the transverse pre-stressing member is preferably arranged to extend through the aligned transverse channels or hollow portions.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth. As used herein the term '(s)' following a noun means the plural and/or singular form of that noun.

As used herein the term 'and/or' means 'and' or 'or', or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which:

FIG. 8A is an overhead perspective view of the timber-based component;

FIG. 8B is a front perspective view showing the position of the pre-stressing members;

FIG. 8C is a plan view of the timber-based component and pre-stressing members;

FIG. 8D is a cross-sectional end view of the timber-based component and pre-stressing members taken through line AA of FIG. 8C;

FIG. 9A is a perspective view of the timber-based component;

FIG. 9B is a front perspective view showing the position of the pre-stressing members;

FIG. 9C is a front perspective view showing the position of the pre-stressing members;

FIG. 9D is a front perspective view showing the position of the pre-stressing members;

FIG. 43A is a front perspective view showing connector rods protruding from sidewalls of the timber-based component of FIGS. 1A to 1D, into the anchor region;

FIG. 43B is another perspective view corresponding to FIG. 43A;

FIG. 43C shows shear connector plates protruding from a timber member;

FIG. 43D shows bolts protruding from a timber member;

FIG. 46A is a partial perspective view of the end of the beam or panel;

FIG. 46B is a cross sectional plan view corresponding to FIG. 46A;

FIG. 46C is a cross sectional end view taken line BB of FIG. 46B; FIG. 47A is a partial perspective view of the end of the beam or panel;

FIG. 47B is a cross sectional plan view corresponding to FIG. 47A;

FIG. 4C is a cross sectional end view taken line CC of FIG. 47B; FIG. 47D is a cross sectional end view taken line DD of FIG. 47B.

DETAILED DESCRIPTION OF PREFERRED FORMS

Pre-Tensioned, Multiple Beams/Panels

Figures 1A, 1B, 1C, 1D:
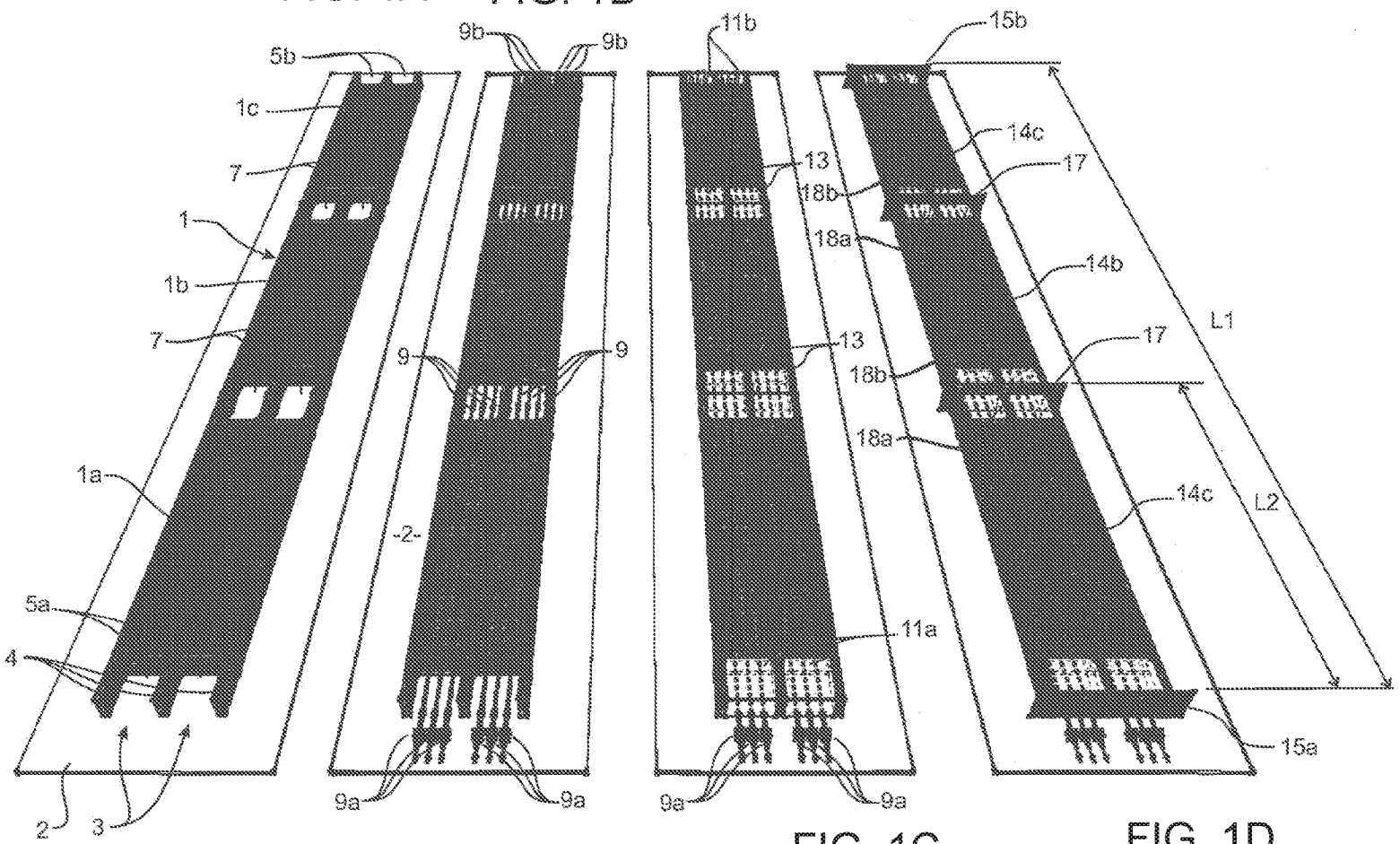
FIG. 1A is a top-front perspective view illustrating a first step of four steps in a preferred form of a method for manufacturing pre-stressed beams.
FIG. 1B is a top-front perspective view illustrating a second step of the four steps in a preferred form of a method for manufacturing pre-stressed beams.
FIG. 1C is a top-front perspective view illustrating a third step of the four steps in a preferred form of a method for manufacturing pre-stressed beams.
FIG. 1D is a top-front perspective view illustrating a fourth step of the four steps in a preferred form of a method for manufacturing pre-stressed beams.

FIGS. 1 to 6 illustrate a method for prefabricating pre-stressed beams according to a first preferred embodiment of the present invention. The method comprises four main phases. In a first phase illustrated in FIGS. 1A and 2, a timber-based component 1 is provided. In the form shown, the timber-based component 1 comprises a timber laminate elongate frame. The frame has a number of webs 4 defining a plurality of longitudinal hollow portions 3 extending through the timber-based component 1 along a substantial part of its length.

At the opposing ends of the timber-based component 1, adjacent webs 4 define a number of spaces 5*a*, 5*b* between the webs 4 that are open at least on an upper side to receive poured concrete for forming a respective discrete end anchor. In the embodiment in FIG. 1A, two intermediate sections 7 along each hollow portion 3 are open at least on an upper side to define cavities for receiving poured concrete and forming respective discrete intermediate anchors. The timber-based component 1 is placed on a casting bed 2. The timber-based component 1 may be a single integrally formed component or comprise two or more members or sub-components 1*a*, 1*b*, 1*c* placed end-on-end on the casting bed.

Figure 3:
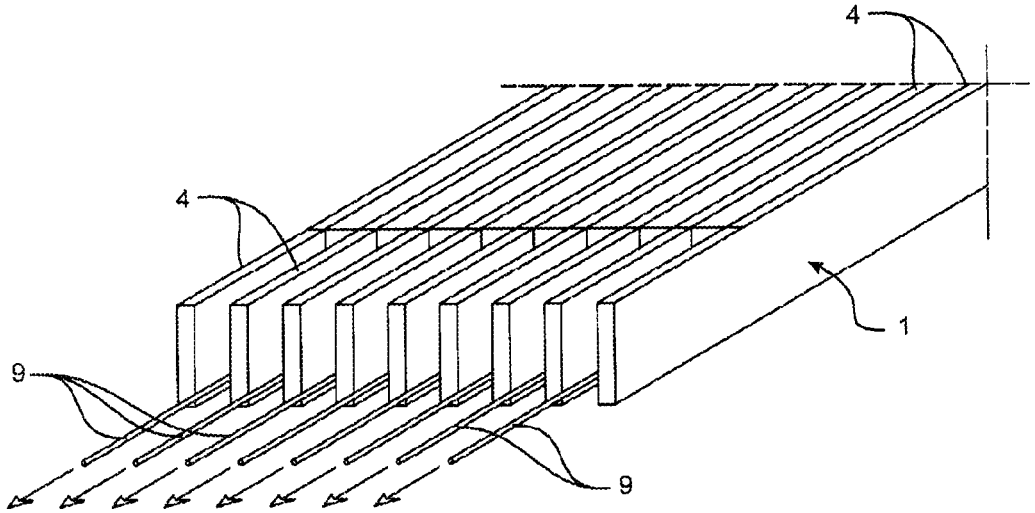
FIG. 3 is a partial front perspective view of the timber-based component of FIG. 2 with inserted pre-stressing members, corresponding to the second step shown in FIG. 1B.

In a second stage illustrated in FIGS. 1B and 3, elongate pre-stressing members 9 are inserted into the hollow portions 3 to extend longitudinally along the timber-based component 1. In the forms shown, the pre-stressing members comprise parallel high-strength steel tendons 9 arranged in the hollow portions 3. In the embodiment in FIG. 1B, three tendons 9 are placed in each hollow portion 3, whereas the embodiment shown in FIG. 3 comprises only one tendon 9 in each hollow portion. More or fewer pre-stressing members could be provided.

The opposing ends of the tendons 9 are connected to tensioning equipment and a tensile force is applied to the tendons 9. The ends 9*a*, 9*b* of the tendons may comprise enlarged portions or attached blocks or other features, as shown in FIG. 1B, to enable the tendons 9 to be more readily grasped by the tensioning equipment. Equipment commonly used for tensioning steel tendons or bars in prefabricated pre-stressed concrete beams would be suitable. In one embodiment, the pre-stressing members 9 are tensioned using a pre-stressing jack to extend the members. The tensile force in the pre-stressing members 9 is then resisted by an anchor block or plate cast in the ground while the concrete cures. In an alternative embodiment, the casting bed may comprise upwardly extending end portions and act as a strut, with the tensile force in the pre-stressing members resisted against the ends of the casting bed while the concrete cures. Where space permits, several timber-based components 1 may be placed side-by-side and pre-stressed simultaneously.

As a further alternative, one or more transverse steel plates connected to the timber-based component 1 may be positioned in or adjacent an end of the open anchor regions 5*a*, 5*b*, 7. The pre-stressing member(s) 9 would extend through apertures or notches in the plate(s) and may be tensioned against the plate(s), for example using a thread and nut arrangement or a pre-stressing cone or wedge, such that the steel plate(s) bear against a portion of the timber-based component to transfer the pre-stressing force. In embodiments with a steel plate positioned within one or more of the anchor regions 5*a*, 5*b*, 7, the poured concrete would at least partially embed the plate(s). In those embodiments, the steel plate may form the boxing for the respective anchor, to contain the poured concrete. The plate may also reduce the required length of the concrete anchor by bearing some of the pre-stressing load.

Methods of tensioning tendons are known to a person skilled in the art. For example, from Collins M. P. and Mitchell D, *Prestressed Concrete Structures*, Prentice Hall, Englewood Cliffs, N.J., USA 1991, Response Publications, Toronto 1997, ISBN 0-9681958-0-6.

Figure 4:
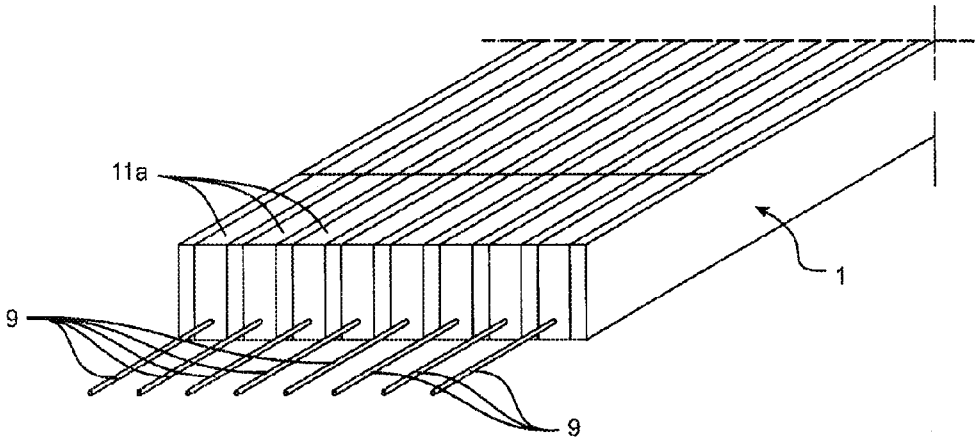
FIG. 4 is a partial front perspective view of the timber-based component of FIGS. 2 and 3 with inserted pre-stressing members and the concrete anchors poured, corresponding to the third step shown in FIG. 1C.

In a third stage illustrated in FIGS. 1C and 4, concrete is poured into the end open regions 5*a*, 5*b* and into the intermediate open regions 7. The ends of each open region 5*a*, 5*b*, 7 typically comprise timber framework to further define the space for the anchor and to prevent concrete from flowing into the remainder of the hollow portion 3.

When the concrete is poured, the portions of the tensioned tendons 9 positioned within the anchor regions 5*a*, 5*b*, 7 are embedded in the concrete. The concrete is then cured to form end anchors 11*a*, 11*b* and intermediate anchors 13 that fixedly couple the tendons 9 to the timber-based component 1. In embodiments where the timber-based component 1 comprises a plurality of shorter members or sub-components 1*a*, 1*b*, 1*c*, the intermediate cavities 7 are each defined between the ends of the respective two adjacent sub-components. When the concrete poured into those intermediate cavities 7 cures, it joins the adjacent sub-components 1*a*/1*b*, 1*b*/1*c* together.

Figure 5:
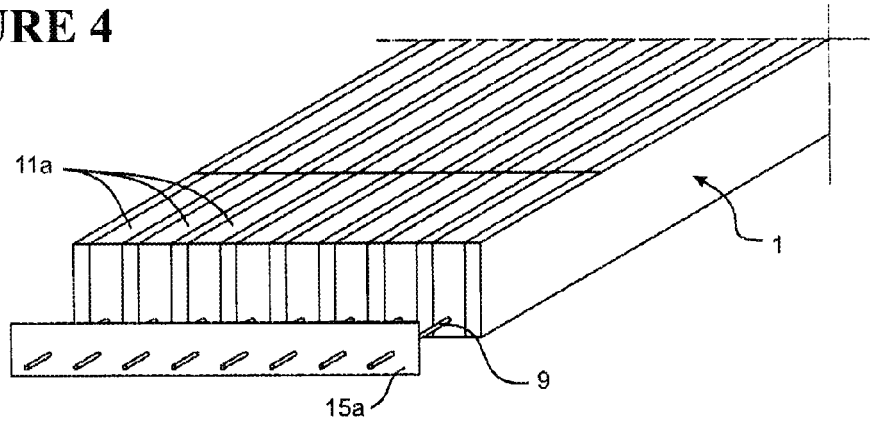
FIG. 5 is a partial front perspective view of the pre-stressed beam resulting from the steps shown in FIGS. 2 to 4, showing a cutting plane for cutting the protruding portions of the pre-stressing members and corresponding to the fourth step shown in FIG. 1D.

In a fourth stage illustrated in FIGS. 1D and 5 the tension applied by the tensioning equipment to the tendons 9 is released once the concrete anchors 11*a*, 11*b*, 13 have substantially cured. The concrete is considered substantially cured, for example, when it reaches at least 70% of the nominal (28 day) compression strength of the concrete. Typically the time taken for the anchors to cure to at least 70% of the 28 day strength is between one and three days depending on the thickness of the slab. The end portions of the tendons 9*a*, 9*b* protruding from the ends of the cured end anchors 11*a*, 11*b* are then removed by cutting through the end cutting planes 15*a*, 15*b* shown in FIG. 1D and FIG. 5. The cured concrete anchors 11*a*, 11*b*, 13 maintain the tendons 9 in a tensioned state and transfer the force from the tendons 9 to the timber-based component 1 as a compressive force, pre-stressing the timber-based component to create an initial pre-stressed beam 14 of length L1.

Figure 6:
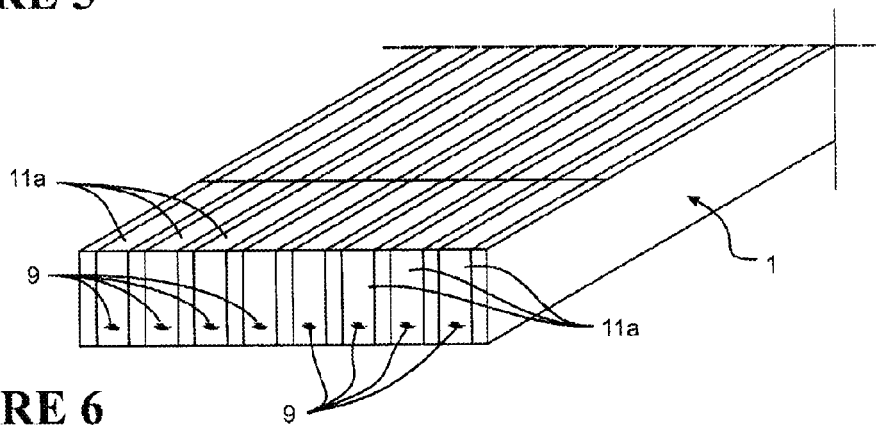
FIG. 6 is a partial front perspective view of the completed pre-stressed beam of FIGS. 2 to 5 after the protruding ends of the pre-stressing members are cut.

FIG. 6 shows an end portion of a pre-stressed beam or panel produced by the method of FIGS. 2 to 5.

The anchors may comprise any suitable concrete including, but not limited to, high strength concrete, light weight concrete, fibre reinforced concrete, or self-compacting concrete. The concrete may additionally contain small aggregates. To reduce weight, the anchors may comprise hollow portions or a timber core. To form an anchor having hollow portions, a core comprising a material such as polystyrene or PVC may be inserted into the anchor region and the concrete poured around the inserted core. The core may be removed when the concrete has been cured. Steel reinforcing may also be used in the anchor region to reinforce the concrete anchor.

The initial pre-stressed beam 14 in FIG. 1D may then be cut along intermediate transverse cutting planes 17, through the intermediate anchors 13 and the tendons 9, into a plurality of shorter beams or sub-beams 14*a*, 14*b*, 14*c* of length L2. The length of each piece 1*a*, 1*b*, 1*c* is the length L2 of the final pre-fabricated beams 14*a*, 14*b*, 14*c*. Each cut intermediate anchor 13 forms two end anchors 18*a*, 18*b* on two adjacent beams 14*a*/14*b* or 14*b*/14*c*. Because the tendons are embedded along the length of intermediate anchors 13, they are also embedded along the length of the resulting new end anchors 18*a*, 18*b*, so that the pre-stress is maintained in the shorter beams 14*a*, 14*b*, 14*c*. The intermediate anchors 13 as initially formed are twice the length of the end anchors 11*a*, 11*b* such that when they are cut through a mid point, the new end anchors 18*a*, 18*b* are the same length as the original end anchors 11*a*, 11*b*.

The anchors are preferably cut using a saw capable of cutting concrete and steel. Alternatively, a polystyrene divider may be placed along the intermediate plane 17 in the intermediate cavities 7 before the concrete is poured. In stage 3, concrete is then poured on both sides of the polystyrene divider. In the final stage, the initial pre-stressed beam 14 may then be cut along intermediate transverse cutting planes 17, through the polystyrene and the tendons 9. This enables faster cutting of the beam. In one example, the polystyrene divider is 10 mm thick.

It can be seen that once cut, the concrete anchors 11*a*, 11*b*, 18*a*, 18*b* are recessed in the ends of the beams or sub-beams, and preferably do not project outwardly beyond the ends of the timber-based component or sub-components.

The cut pre-stressed beams 14*a*, 14*b*, 14*c* may then be transported to a construction site for use. The beams may be used for constructing suspended floors, roofs, walls or some bridges, for example.

This process has the advantage that a plurality of final beams 14*a*, 14*b*, 14*c* can be pre-stressed at the same time, making more efficient use of tensioning equipment for high volume production.

Pre-Tensioned, Single Beam

Figure 7A:
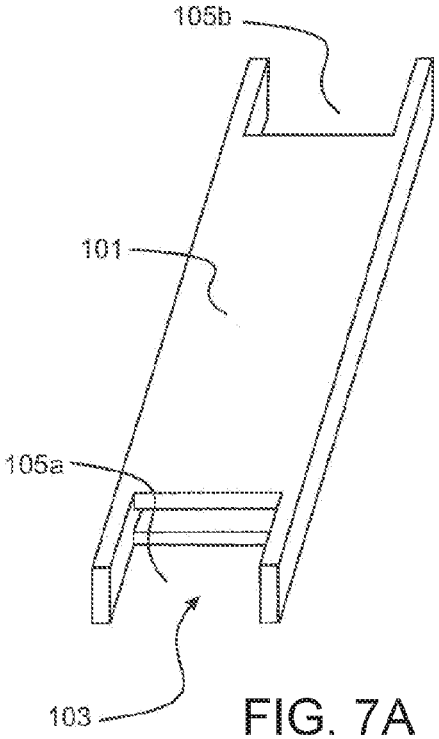
FIG. 7A is a perspective view showing step one of three steps in the manufacture of an alternative 2-anchor embodiment, corresponding to step one shown in FIG. 1A and FIG. 2.
Figure 7B:
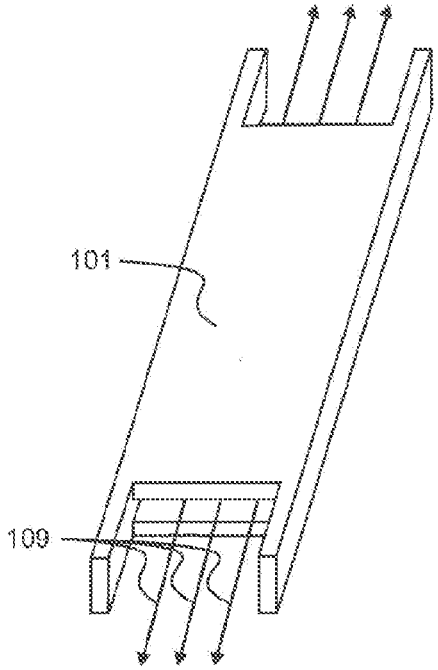
FIG. 7B is a perspective view showing step two of the three steps in the manufacture of an alternative 2-anchor embodiment, corresponding to step two shown in FIG. 1B and FIG. 3.
Figure 7C:
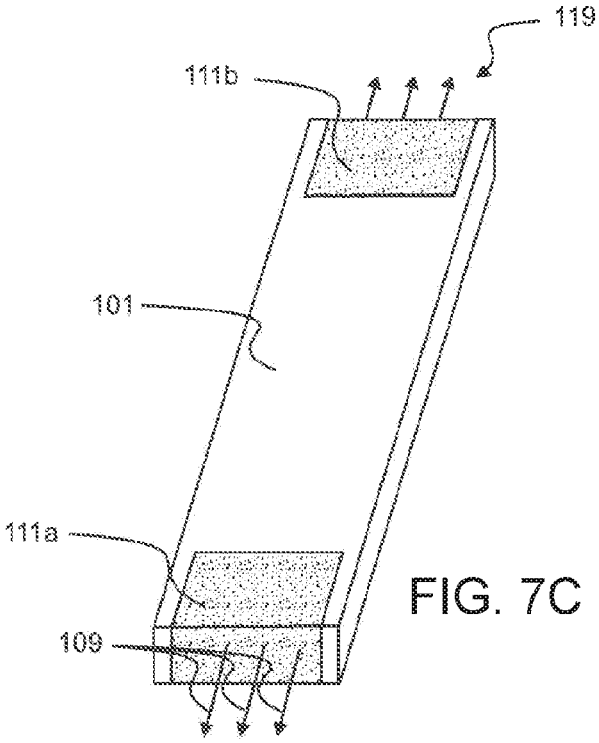
FIG. 7C is a perspective view showing step three of the three steps in the manufacture of an alternative 2-anchor embodiment, corresponding to step three shown in FIG. 1C and FIG. 4.
Figure 8A:
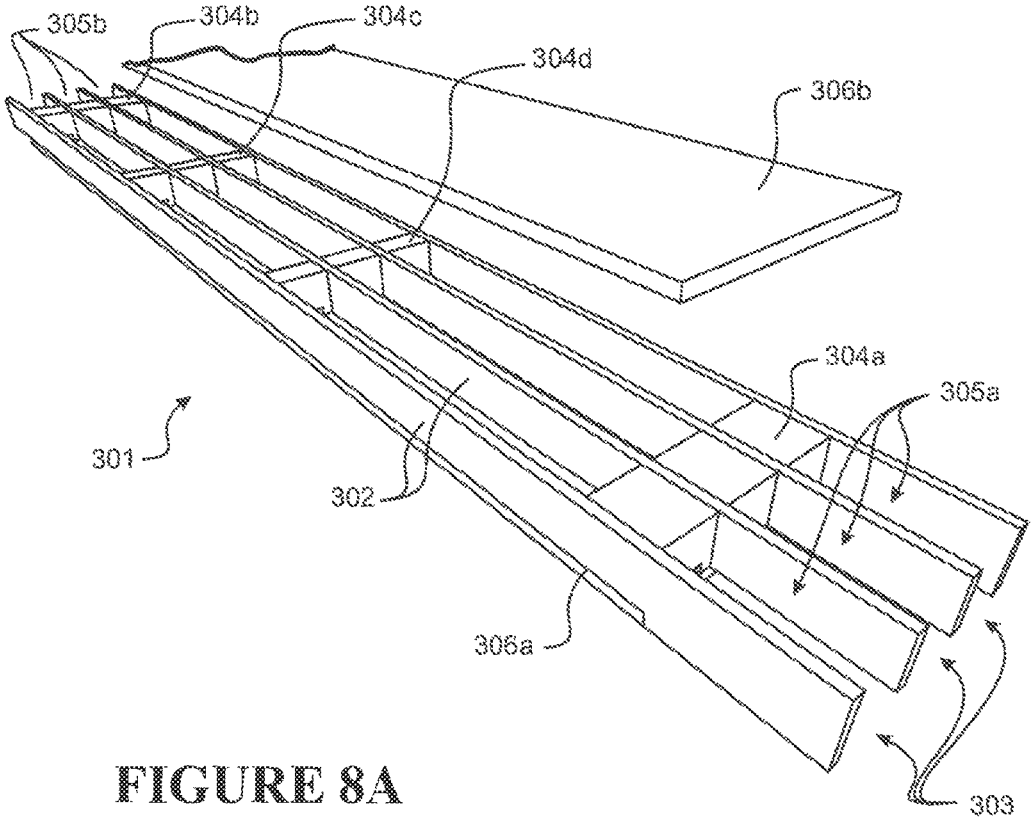
FIG. 8A shows a timber-based component for producing a preferred form pre-stressed beam having two end anchors, where
Figure 8B:
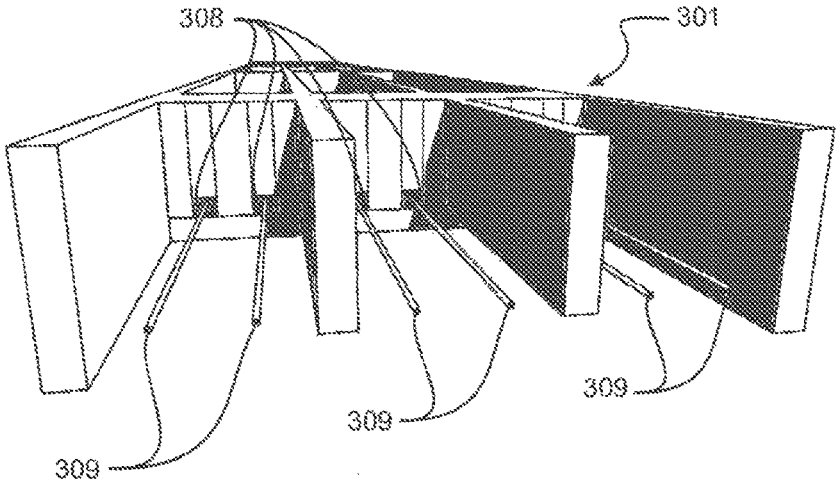
FIG. 8B shows a timber-based component for producing a preferred form pre-stressed beam having two end anchors, where
Figure 8C:
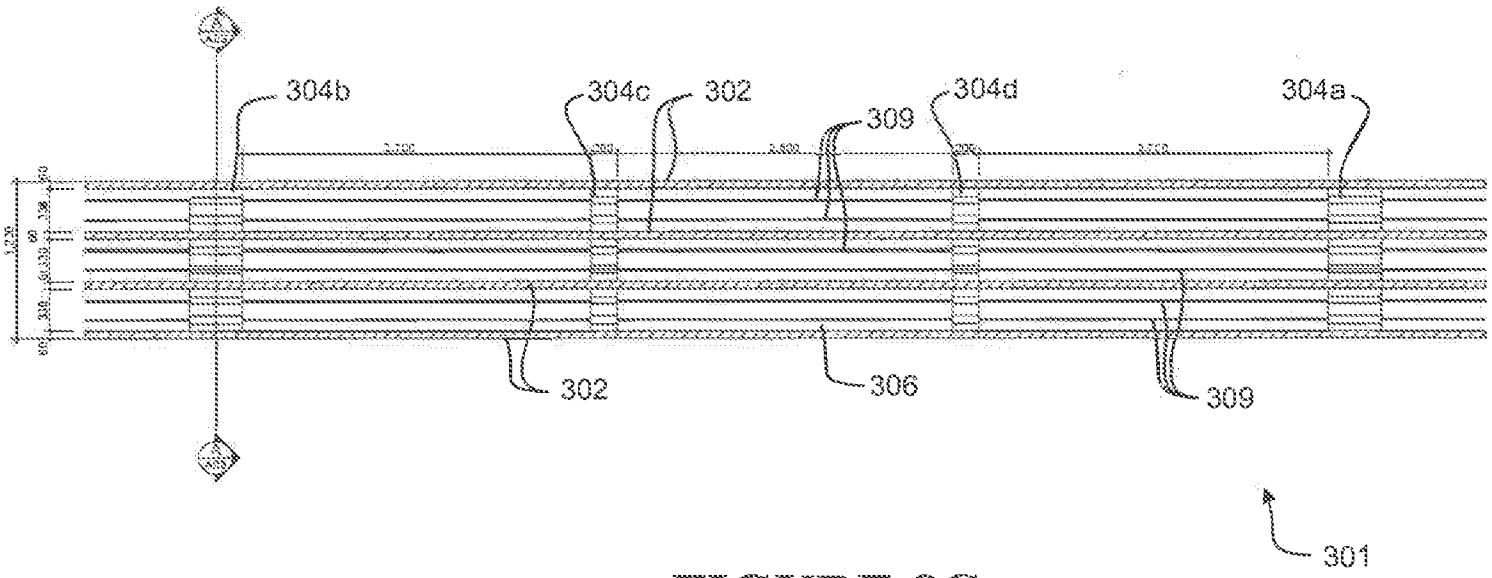
FIG. 8C shows a timber-based component for producing a preferred form pre-stressed beam having two end anchors, where
Figure 8D:
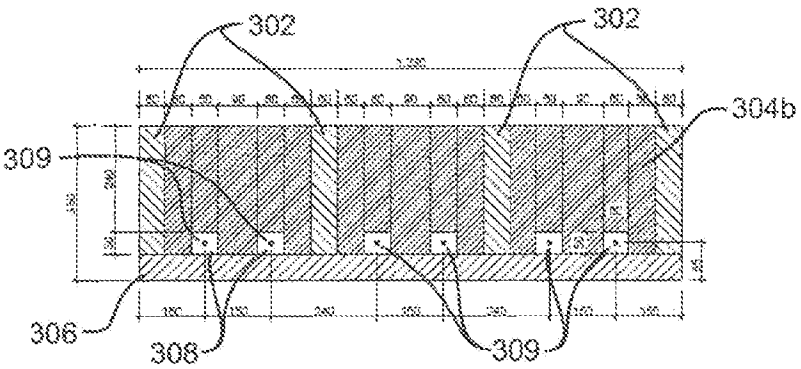
FIG. 8D shows a timber-based component for producing a preferred form pre-stressed beam having two end anchors, where
Figure 9A:
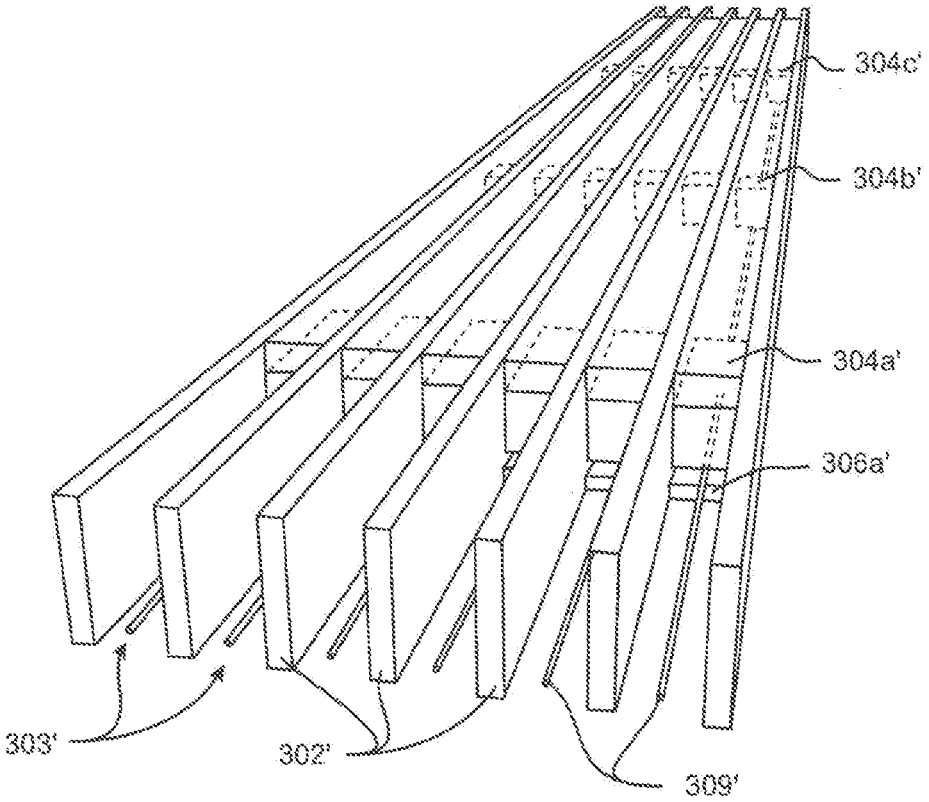
FIG. 9A is similar to FIG. 8A and shows an alternative timber-based component for producing a second preferred form pre-stressed beam having two end anchors, where
Figure 9B:
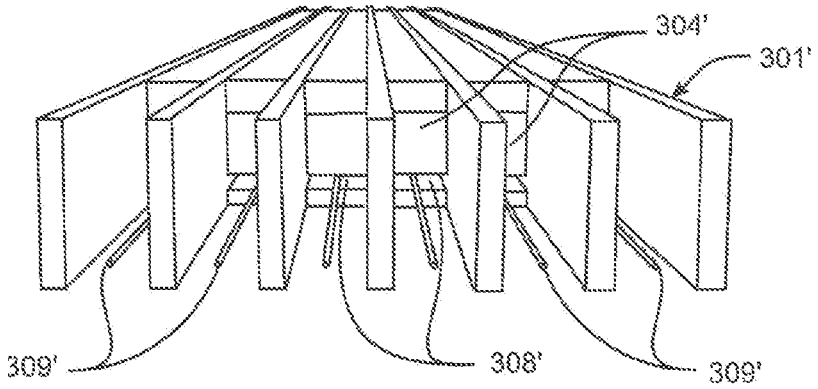
FIG. 9B is similar to FIG. 8B and shows an alternative timber-based component for producing a second preferred form pre-stressed beam having two end anchors, where
Figure 9C:
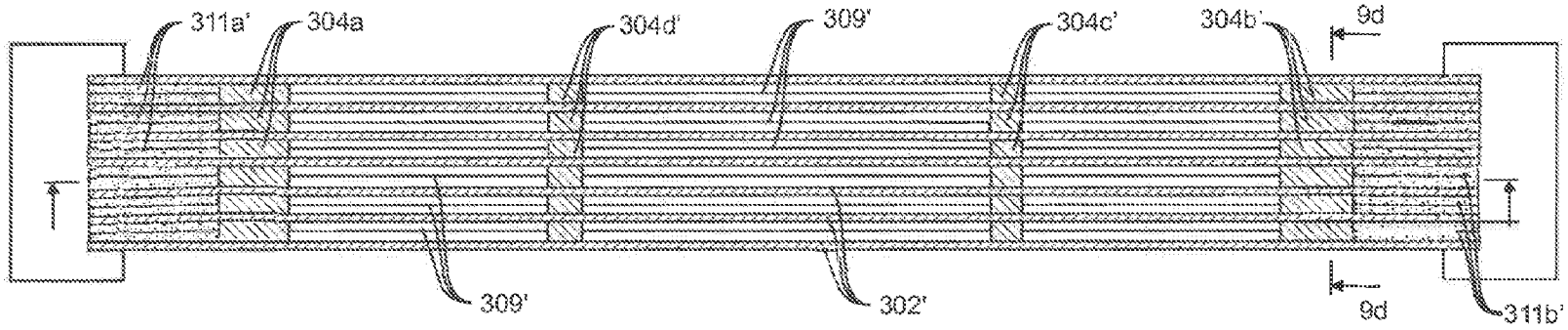
FIG. 9C is similar to FIG. 8C and shows an alternative timber-based component for producing a second preferred form pre-stressed beam having two end anchors, where
Figure 9D:
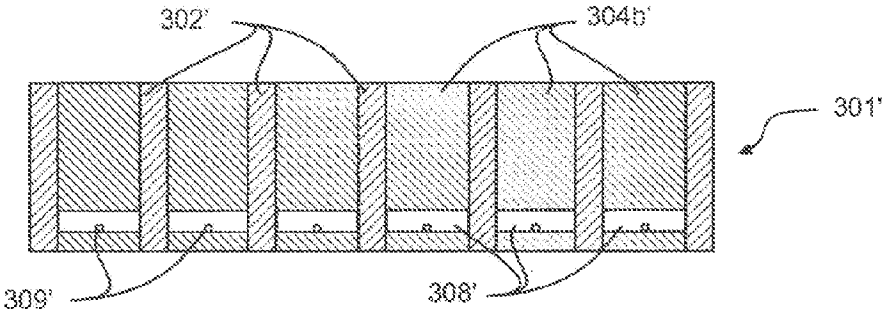
FIG. 9D is similar to FIG. 8D and shows an alternative timber-based component for producing a second preferred form pre-stressed beam having two end anchors, where

An alternative preferred embodiment method for producing a single pre-stressed beam is shown schematically in FIGS. 7A to 7C. In that embodiment, the timber-based component 101 comprises a single elongate hollow 103, with the ends 105*a*, 105*b* of the hollow defining regions for end anchors, but with no intermediate regions for intermediate anchors. The process for pre-stressing the beam is substantially as described above: the tendons 109 are inserted through the hollow and tensioned using tensioning equipment, and concrete is poured into the end spaces 105*a*, 105*b* and allowed to cure to form end anchors 111*a*, 111*b* only. Boxing or plates (not shown) at the ends of each anchor region contain the concrete and prevent the poured concrete flowing down the length of the hollow 103. The boxing or plates contain apertures or notches for the pre-stressing tendons 109 to pass through.

Once the concrete anchors 111*a*, 111*b* have substantially cured, tension is released from the tendons and protruding portions of the tendons 109 are removed to form a final pre-stressed beam 119. This embodiment differs from the above method in that the beam formed cannot be cut into shorter lengths, so only a single pre-fabricated beam or panel is produced. This process may be used where there is insufficient space for a plurality of beams to be pre-stressed end-on-end, where there are only low-volume requirements, or for beams or panels with custom dimensions, for example. The method and formed pre-stressed beam may have any one or more of the features described above in relation to the embodiment of FIGS. 1A to 6.

FIGS. 8A to 8D and FIGS. 9A to 9D show two possible preferred embodiments of a timber-based component 301, 301' suitable for producing a single pre-stressed beam such as the one shown in FIG. 7A to 7C, or for placing in series with other like components to produce a long pre-stressed member that can be cut, as shown in FIGS. 1A to 1D. In the embodiment of FIGS. 8A to 8D, the timber-based component 301 comprises four vertical timber laminate members 302 measuring about 60 mm thick, 350 mm deep, and 10-12 m long. The vertical members 302 are positioned between a lower flange member 306*a* and an upper flange member 306*b* and spaced apart by deviators 304*a*, 304*b*, 304*c*, 304*d*. The deviators 304*a*, 304*b*, 304*c*, 304*d* and the lower flange member 306*a* define a plurality of apertures 308 to receive pre-stressing tendons 309. The tendons 309 are arranged through the apertures 308 and extend along the hollow portions 303 between respective vertical members 302. The deviators 304*a* and 304*b* at the ends of the component and the vertical members 302 together define regions 305*a*, 305*b* for casting concrete end anchors. The cross sections of the end anchor regions 305*a*, 305*b* are much larger than the cross sections of the apertures 308 through which the tendons 309 extend. The intermediate deviators 304*c*, 304*d* provide additional stiffness and strength for the beam.

The embodiment of FIGS. 9A to 9D is similar to the embodiment of FIGS. 8A to 8D, with like numbers used to indicate like parts, but with the addition of a prime (').The timber-based component 301' comprises seven vertical timber laminate members 302', with a single tendon 309 positioned between adjacent vertical timber laminate members 302'. When intermediate concrete anchor(s) 13 will be included, intermediate deviators 304*c*, 304*c'*, 304*d*, 304*d'* may be positioned at spaced apart points, with at least some of the spacing of the intermediate deviators being configured to define the desired length of the intermediate anchor(s). The upper flange member 306*b* will be provided with corresponding recess(es).

Pre-Fabricated Anchors

Rather than pre-tensioning the pre-stressing cables and pouring the anchors as described above, the concrete anchors 32 may be at least partially pre-cast, and the cables post-tensioned. FIGS. 10 to 14 illustrate an alternative embodiment method for pre-fabricating pre-stressed beams or panels using pre-cast anchors. The method comprises five main phases.

Figure 10:
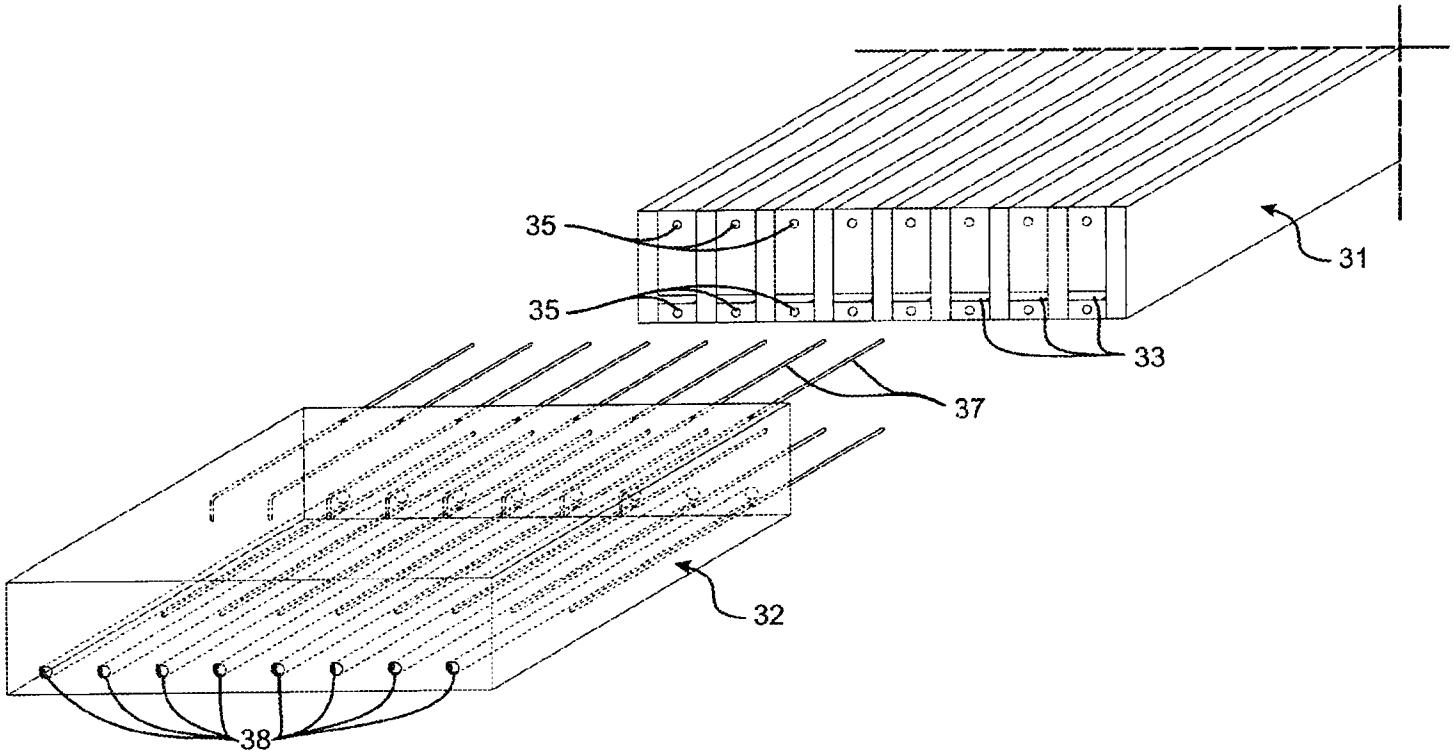
FIG. 10 is a partial front perspective view of a timber-based component similar to the timber-based component in FIGS. 9A to 9D, and an unattached pre-fabricated concrete anchor, illustrating a first step of an alternative form method for manufacturing pre-stressed beams or panels.

FIG. 10 illustrates a first phase in which a timber-based component 31 and two pre-fabricated concrete end anchors 32 are positioned in a yard (only one anchor is shown). The pre-cast concrete anchors 32 comprise attachment features for attachment to the timber-based component 31. In the embodiment shown, each pre-cast anchor 32 comprises a series of starter bars 37 positioned towards the top and bottom of the anchor 32. Each starter bar 37 has an end embedded in the anchor 32 and a protruding end. The end of the timber-based component 31 comprises a series of corresponding holes 35 for receiving the starter bars 37. The holes 35 may be pre-drilled or provided in any other known manner.

Figure 11B:
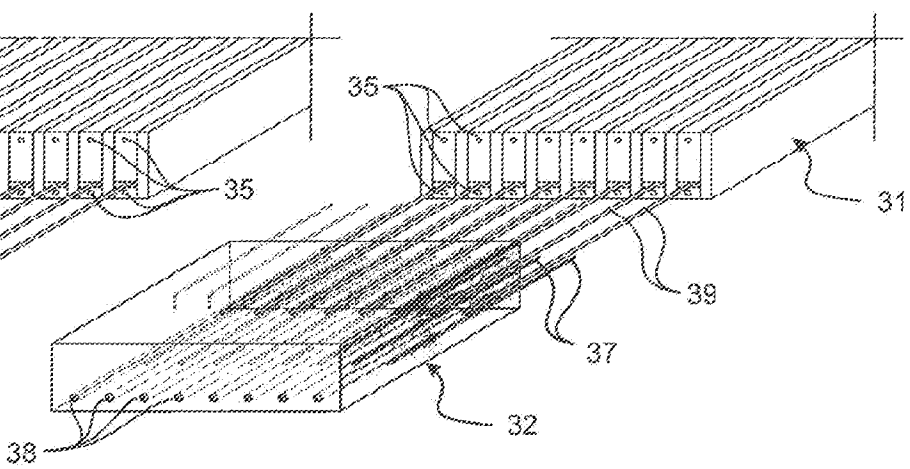
FIG. 11B is a partial front perspective view illustrating a second step in the alternative form method of FIG. 10.
Figure 11A:
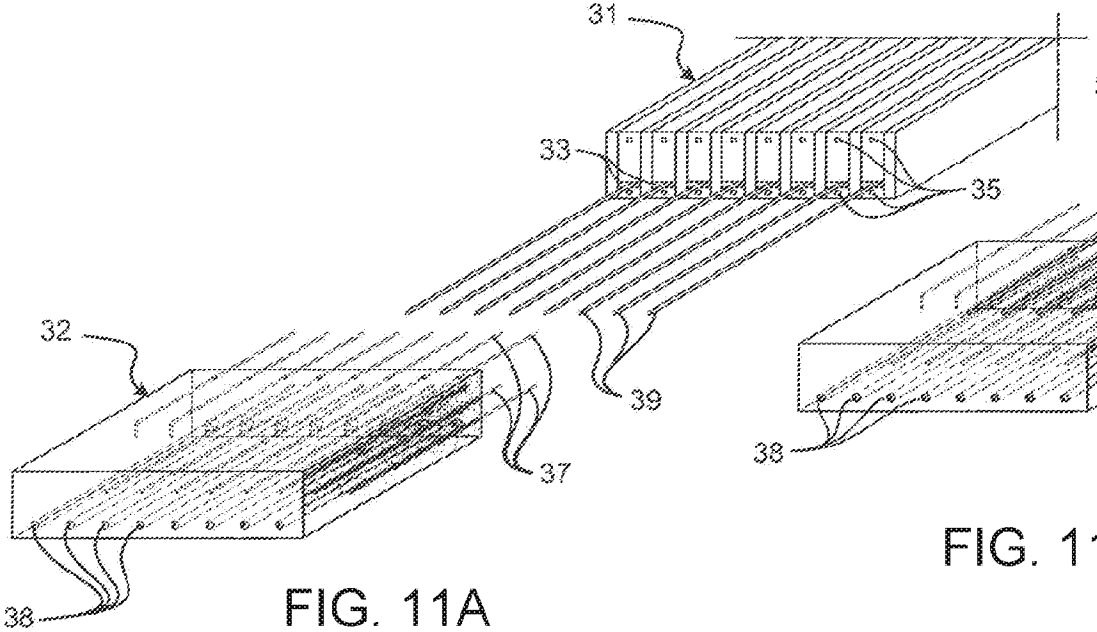
FIG. 11A is a partial front perspective view illustrating a second step in the alternative form method of FIG. 10.
Figure 12:
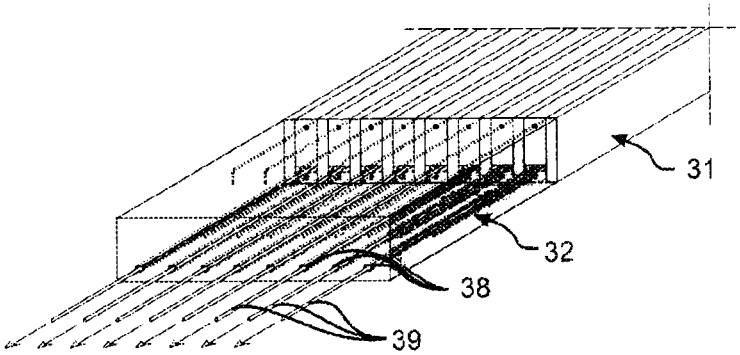
FIG. 12 is a partial front perspective view illustrating a third step in the method of FIGS. 10, 11A, and 11B.
Figure 13:
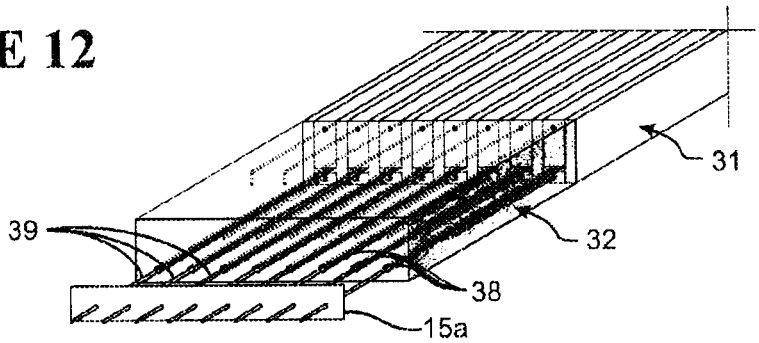
FIG. 13 is a partial front perspective view illustrating a fourth step in the method of FIGS. 10 to 12.
Figure 14:
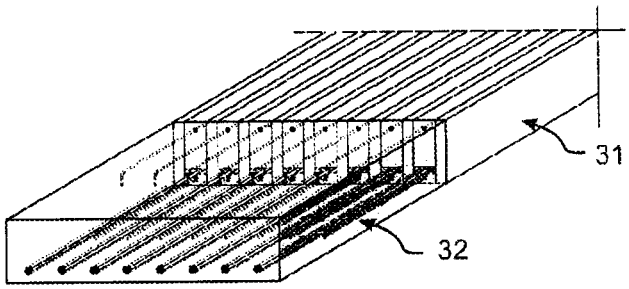
FIG. 14 is a partial front perspective view showing an end portion of a pre-stressed panel formed by the method of FIGS. 10 to 13.

In a second phase of the method, illustrated in FIGS. 11A and 11B, the anchors 32 and the timber based component 31 are assembled so that the starter bars 27 are positioned in the holes 35 in the timber-based component 31. The starter bars 37 are attached to the timber-based component 31 in any suitable manner such as by injecting epoxy or other substance in the holes 35.

The timber-based component 31 comprises a plurality of ducts 33 which extend along the length of the component 31 for receiving pre-stressing members 39. The pre-cast anchor 32 also comprises a series of ducts or apertures 38 that align with the ducts 33 in the timber-based component 31 when the anchor and timber component 31 are assembled.

A single pre-stressing member 39 is placed through each duct 33 in the timber-based component 31, and the corresponding duct 38 in the anchor 32. Alternatively, several pre-stressing members 39 may be placed in each duct 33, 38. In a third phase, shown in FIG. 12, the pre-stressing members 39 are tensioned. Concrete or grouting is then injected in the ducts 38 in the concrete anchors 32. Once the concrete or grouting has substantially cured, the tension is released from the pre-stressing members 39.

In addition to two end anchors 32, the method may also comprise placing one or more intermediate pre-cast anchors between the ends of two timber-based sub components in a similar manner to the embodiment of FIGS. 1A to 1D. Intermediate anchors would comprise starter bars or other attachment features at both ends of the anchor to connect to the ends of two adjacent timber-based components 31. While the pre-stressing members 39 are tensioned, concrete or grouting is injected in the ducts 38 in the intermediate concrete anchor(s).

Once the grouting has substantially cured, the initial pre-stressed beam or panel may be cut along intermediate transverse cutting planes through the intermediate anchors and the pre-stressing members 39, forming a plurality of shorter beams or panels. Because the tendons are grouted along the length of intermediate anchors, they are also embedded along the length of the resulting new end anchors so that the pre-stress is maintained in the shorter beams. As described with respect to the embodiment of FIGS. 1A to 1D, the initial, uncut intermediate anchor(s) is/are twice the length of the end anchors, so the new end anchors formed by cutting the intermediate anchor(s) are the same length as the original end anchors 32.

Instead of the starter rods 37 and drilled holes 33, other suitable fasteners may be used. For example, the timber-based component 31 or the concrete anchors 32 may comprise metallic ducts for receiving rods or screws attached to the other of the concrete anchors 32 or the timber-based component 31. The rods or screws may be screwed, bolted or epoxied into the other of the timber-based component 31 or the anchors 32.

As a further alternative, rather than using concrete or grouting to couple the pre-stressing members to the pre-cast anchors 32, the pre-stressing members 39 may be mechanically coupled to the pre-cast anchors 32. For example, the pre-stressing members may be threaded members and may be post-tensioned by tightening a nut that then abuts the end of the pre-cast anchor 32 or a plate at the end of each end anchor 32. The concrete anchors diffuse the stresses from the mechanical coupling to the timber-based component 31 and offer a lower-cost solution than coupling the pre-stressing members to the timber-based component using a steel plate, which would need to be thick to diffuse the stresses.

Concrete Topping Layer

Any of the beam or panel embodiments described above may optionally comprise a concrete-based topping layer. FIGS. 15 to 21 illustrate the steps for forming a preferred embodiment panel similar to the embodiment shown in FIGS. 2 to 6, but having a concrete topping layer.

Figure 2:
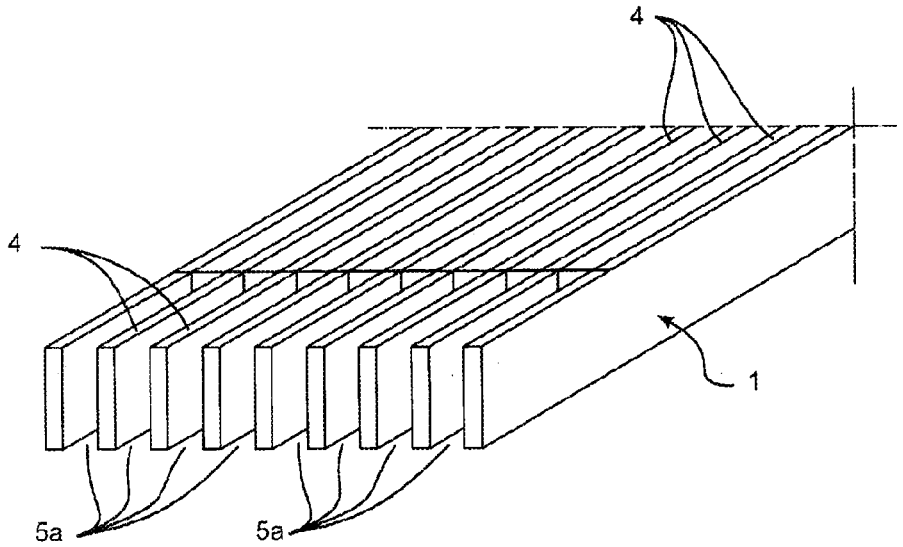
FIG. 2 is a partial front perspective view of one end of a timber-based component, corresponding to the first step shown in FIG. 1A.
Figure 15:
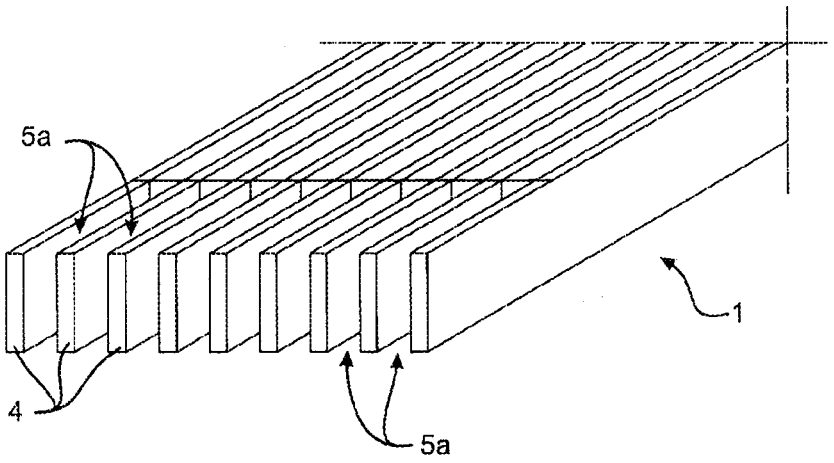
FIG. 15 is a partial front perspective view of a timber-based component, illustrating a first step of a further alternative form method for manufacturing pre-stressed beams or panels having a concrete topping layer.

In a first phase shown in FIG. 15, a timber-based component 1 similar to the timber-based component of FIG. 2, is provided and placed on a casting bed. In the form shown, the timber-based component comprises a timber laminate elongate frame. The frame has a number of webs 4 defining a plurality of longitudinal hollow portions extending through the timber-based component along a substantial part of its length and a number of spaces 5*a* between the webs at opposing ends that are open at least on an upper side to receive poured concrete for forming respective discrete end anchors.

Figure 16:
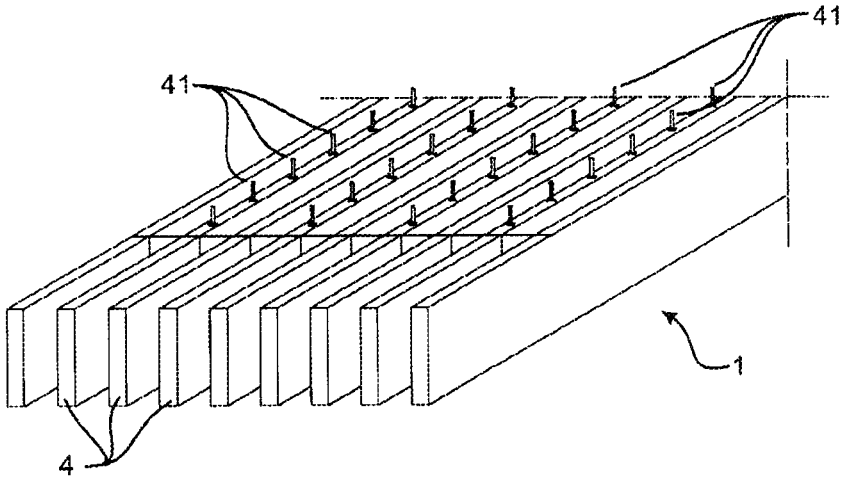
FIG. 16 is a partial front perspective view illustrating a second step in the method of FIG. 15.

In a second phase shown in FIG. 16, fasteners 41 are attached to the top flange of the timber-based component 1 and protrude upward from the top flange. Preferably the fasteners 41 are positioned in line with the webs 4. Suitable fasteners 41 include screws, bolts or steel bars. The screws may be inclined such as at 45° for example in both the forward and rearward directions. Steel bars may be fixed to the timber-based component such as by being epoxied. The fasteners 41 may be attached to the timber-based component 1 either before or after placing the timber-based component on the casting bed. Alternatively, the top flange of the timber-based component may contain notches in the flange, and protruding studs.

Figure 17:
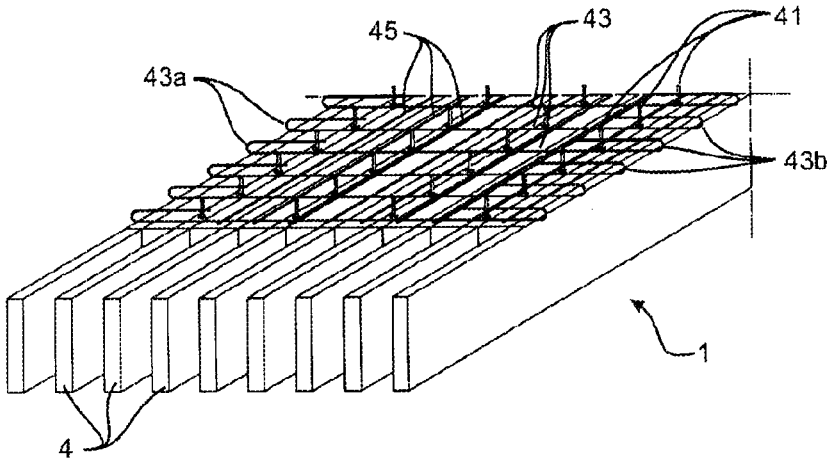
FIG. 17 is a partial front perspective view illustrating a third step in the method of FIGS. 15 and 16.

In a third phase, shown in FIG. 17, longitudinal and transverse steel reinforcing bars 43, 45 or a steel mesh are placed on top of the timber flange. The transverse bars 43 may comprise end hooks 43*a*, 43*b*. The end hooks 43*b* on one side of the panel may overhang the side of the panel to facilitate joining two adjacent panels and forming a continuous surface as discussed further below.

Figure 18:
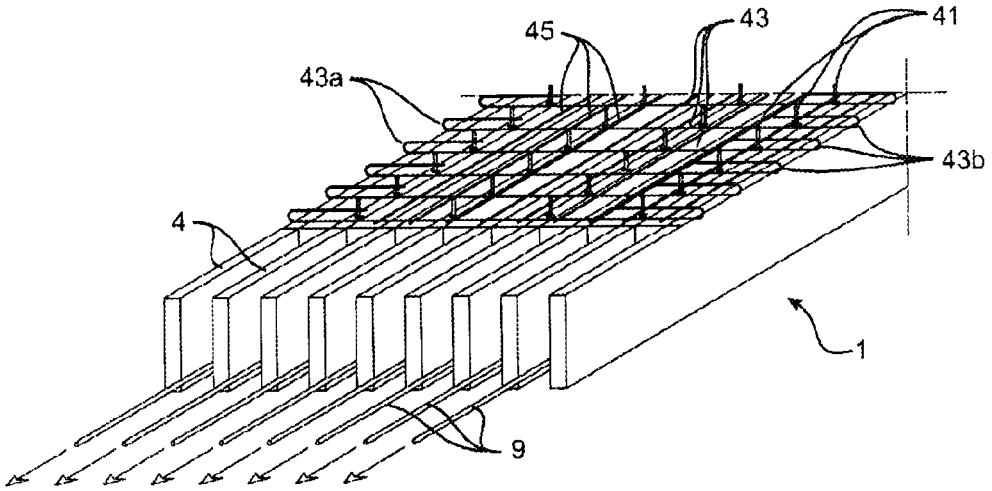
FIG. 18 is a partial front perspective view illustrating a fourth step in the method of FIGS. 15 to 17.

FIG. 18 illustrates a fourth stage, in which elongate pre-stressing members 9 are inserted into the hollow portions 3 in the timber-based component 1 in the same manner described above with reference to the embodiment of FIG. 3. The opposing ends of the tendons 9 are connected to tensioning equipment and a tensile force is applied to the tendons, for example using a pre-stressing jack.

Figure 19:
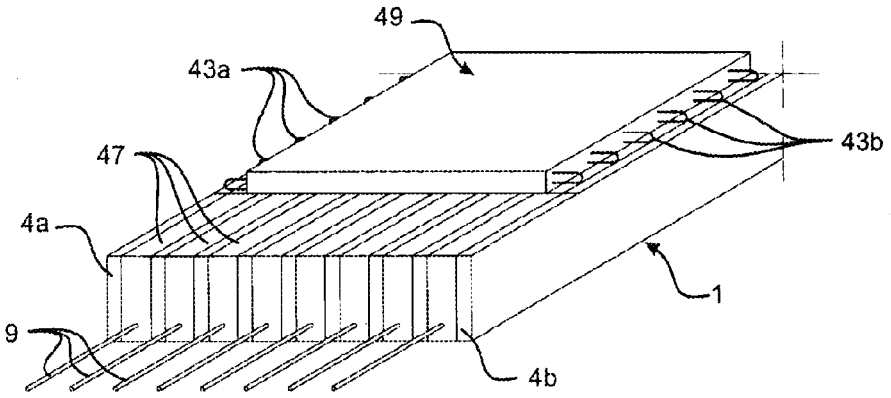
FIG. 19 is a partial front perspective view illustrating a fifth step in the method of FIGS. 15 to 18.

In a fifth stage shown in FIG. 19, while tension is still applied to the pre-stressing members 9, concrete is poured on top of the flange of the timber-based component 1 and in the end anchor regions 5*a* (and anchor regions at an opposing end, not shown). This casts the topping layer 49 and the anchors 47 in a single step.

Preferably the concrete topper does not cover the two webs 4*a*, 4*b* on the sides of the timber-based component 1, and hooked ends 43*a*, 43*b* protrude from the concrete topping layer.

Figure 20:
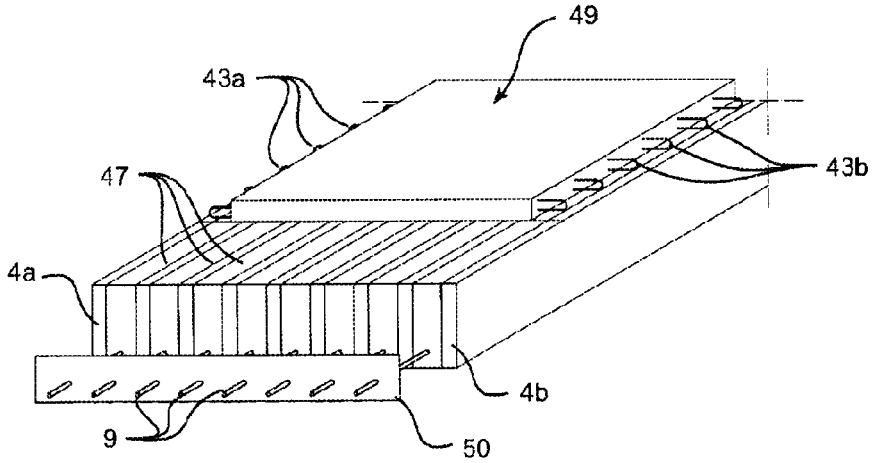
FIG. 20 is a partial front perspective view illustrating a sixth step in the method of FIGS. 15 to 19.
Figure 21:
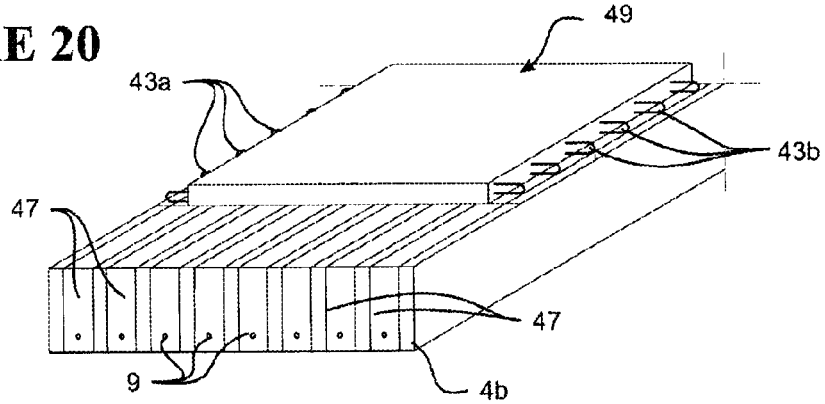
FIG. 21 is a partial front perspective view showing and end portion of a pre-stressed panel formed by the alternative form method of FIGS. 15 to 20.

In two further stages illustrated in FIGS. 20 and 21, the concrete anchors 47 and the concrete layer 49 are allowed to substantially cure. Once the concrete is substantially cured, for example, when it reaches at least 70% of the nominal (28 day) compression strength of the concrete, the tension applied by the tensioning equipment to the tendons 9 is released. The protruding portions of the tendons 9 are then removed from each end of the panel by cutting through end cutting planes 50.

FIGS. 15 to 21 show a preferred embodiment panel in which the entire panel, including the topping layer, is pre-fabricated. Alternatively the concrete topping layer may be poured in situ (on site) on a pre-fabricated pre-stressed beam or panel, for example on the panel shown in FIG. 6.

In embodiments where the concrete topping layer is poured in situ, the steps of FIGS. 2 to 6 are carried out in the casting yard. Fasteners 41 are attached to the top flange of the timber-based component 1 in a similar manner to in FIG. 16, either while the timber-based component 1 is in the casting yard, or on site. Once the pre-stressed beam or panel is on site, reinforcing members such as the steel bars 43, 45 in FIG. 17 are placed on top of the timber-based component 1. The concrete topper 49 is then cast on site.

The fasteners 41 in the above described embodiments bond the concrete topping layer to the timber-based component.

Figure 22:
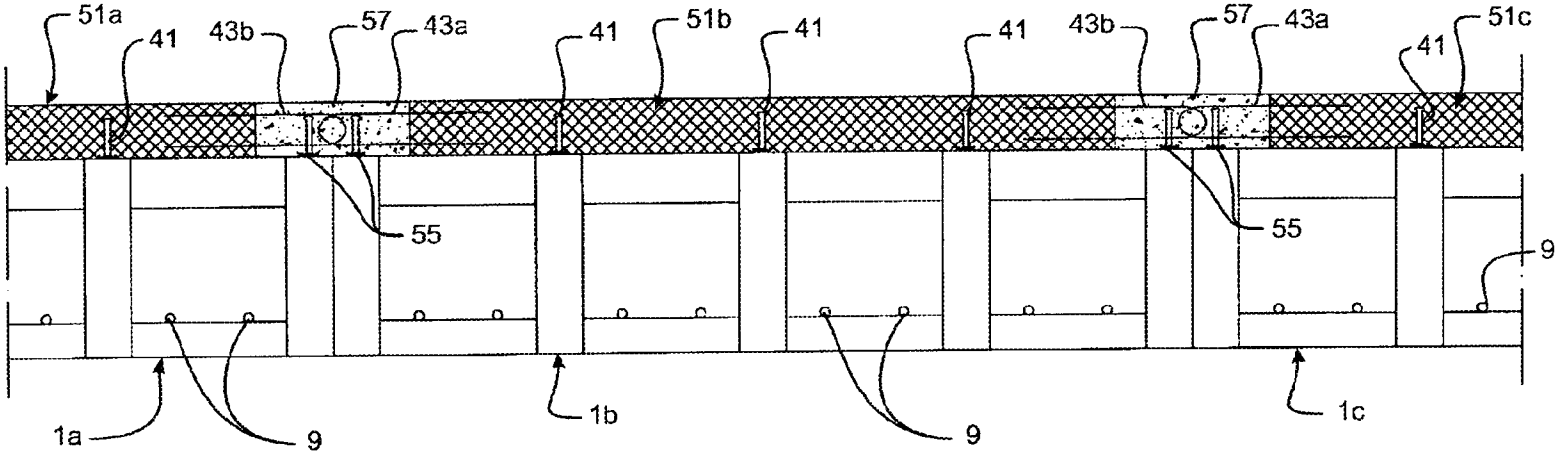
FIG. 22 is a partial cross sectional view of an arrangement having multiple adjacent pre-stressed panels, each panel having a concrete topping layer formed by the method of FIGS. 15 to 20, with respective concrete topping layers on adjacent panels connected to form a continuous surface.
Figure 23:
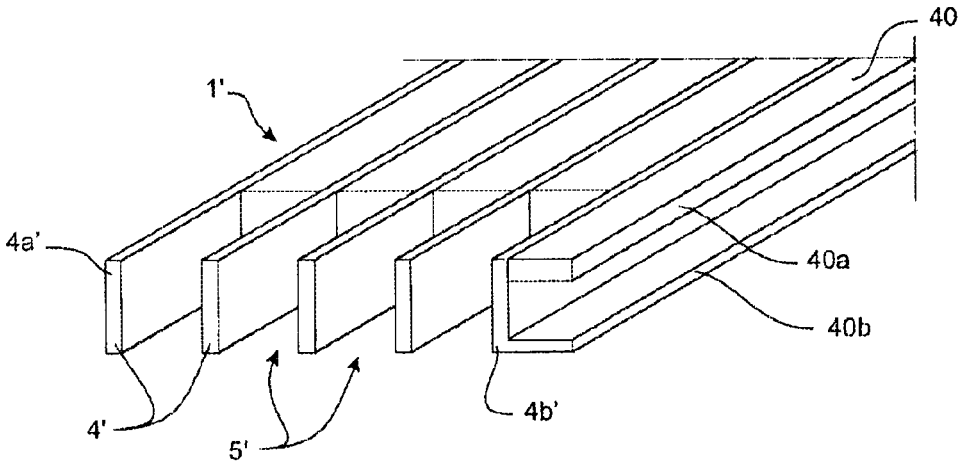
FIG. 23 is a partial front perspective view of a further alternative form timber-based component, illustrating a first step of a further alternative form method for manufacturing pre-stressed beams or panels having a concrete topping layer.
Figure 24:
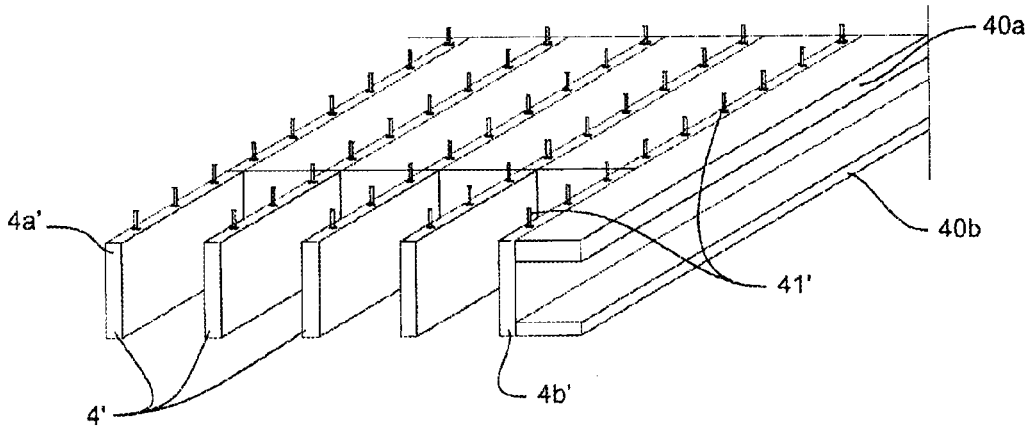
FIG. 24 is a partial front perspective view illustrating a second step in the method of FIG. 23.
Figure 25:
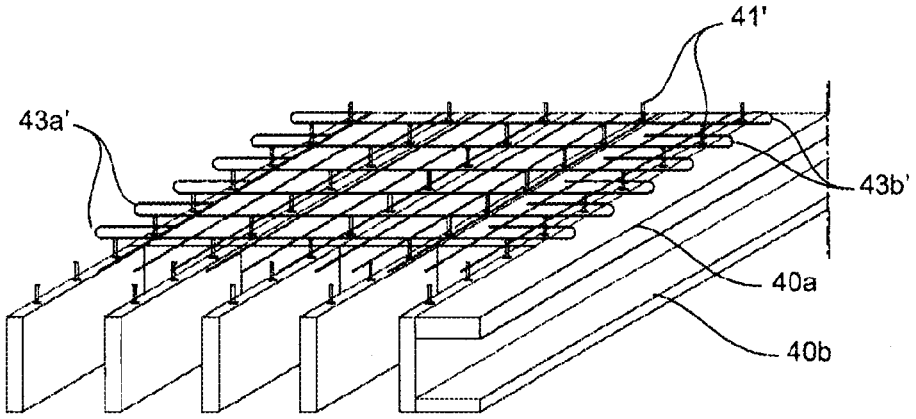
FIG. 25 is a partial front perspective view illustrating a third step in the method of FIGS. 23 and 24.
Figure 26:
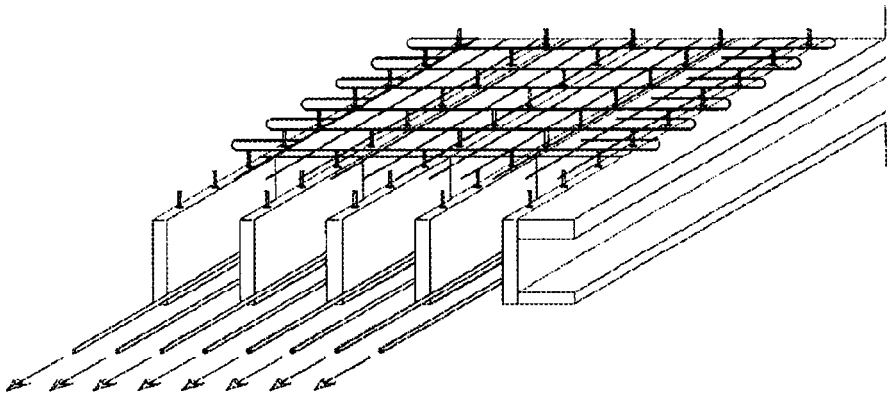
FIG. 26 is a partial front perspective view illustrating a fourth step in the method of FIGS. 23 to 25.
Figure 27:
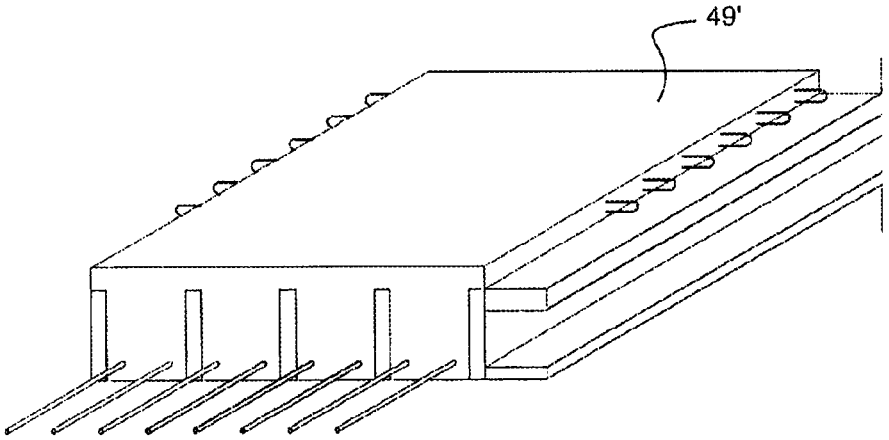
FIG. 27 is a partial front perspective view illustrating a fifth step in the method of FIGS. 23 to 26.
Figure 28:
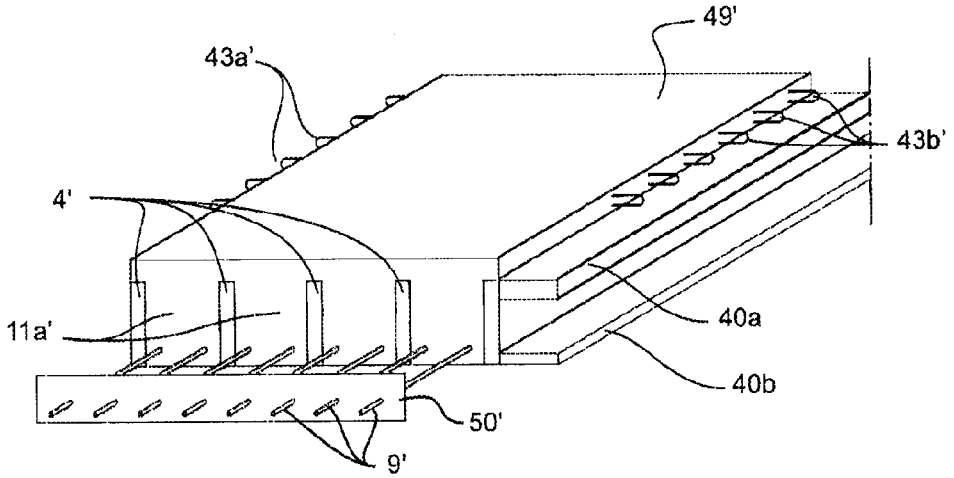
FIG. 28 is a partial front perspective view illustrating a sixth step in the method of FIGS. 23 to 27.

Once the pre-stressed panels are at the construction site, the panels may be placed side-by-side to form a large supporting surface such as a floor. FIG. 22 is cross-sectional view showing connections between a plurality of pre-stressed panels with concrete topping layers 51*a*, 51*b*, and 51*c*. Adjacent panels are arranged with adjacent timber-based constructions 1*a*, 1*b*, and 1*c* abutting to define a channel/space between the adjacent concrete topping layers 51*a*, 51*b*, 51*c*, above the timber-based constructions 1*a*, 1*b*, and 1*c*.

The hooked ends 43*a*, 43*b* of the transverse reinforcing bars in the concrete topping layers protrude into the spaces between topping layers 51*a*, 51*b*, 51*c* and overlap with the hooked ends 43*a*, 43*b* of the reinforcing bars in an adjacent panel. In a final step, concrete 57 is poured into the spaces between the adjacent slabs 51*a*, 51*b*, 51*c*, embedding the protruding, hooked portions 43*a*, 43*b* of the steel reinforcing to form a continuous surface.

Optionally, fasteners 55 may also be attached to the timber-based component 1 in the spaces between adjacent topping layers 51*a*, 51*b*, 51*c*. Those fasteners are then embedded in the strips of concrete 57 that are poured to join the slabs to improve the connection between the topping layer and the timber based component 1.

In alternative embodiments, the concrete topping layer may not be bonded to the timber-based component or may only be partially bonded. For example, the step of attaching fasteners to the timber-based component 1 (FIG. 16) may be omitted. Instead the reinforcing members 43, 45 may be placed on the timber-based component shown in FIG. 15, or on site on the pre-fabricated panel of FIG. 6. The concrete topping layer is then cast over the reinforcing members 43, 45.

As a further alternative, the concrete topping layer may comprise pre-cast reinforced slabs that are placed on the timber-based component 1 on site and attached by fasteners.

The concrete topping layer improves the fire, acoustic, and vibration performance of a given beam or panel. The topping layer also may improve performance of the beam or panel during a seismic event by helping to transfer inertial forces to frames and walls supporting the beam or panel.

An unbonded concrete topping layer may be cheaper and/or easier to manufacture than a fully bonded layer, but still provide most of the advantages mentioned above.

However, an unbonded concrete topping layer acts as a dead weight that must be supported by the pre-stressed timber beam or panel, in contrast, when the concrete topping layer at least partially bonded to the timber-based component, the topping layer contributes to the strength of the pre-stressed beam or panel. Therefore, a smaller beam or panel is required for a given application if the topping layer is at least partially bonded.

For example, one embodiment of a panel has an unbonded concrete topping layer between 65 and 75 mm thick. In a comparable panel with a bonded topping layer of the same thickness, the thickness/depth of the timber-based component would be less than for the timber-based component in the panel with the unbonded topping layer, resulting in a lighter panel. The span of the beam generally determines the thickness of the timber-based component. For example, a panel having an 8 m span may be 360 mm deep, including a 65 mm concrete topping layer. Whereas a panel with a 6 m span may be only 210 mm deep, including a 65 mm concrete topping layer. If the concrete layer is included as a 'diaphragm' for seismic events, the thickness of the concrete topping layer in a bonded panel may be less than for an unbonded panel.

FIGS. 23 to 27 show an alternative embodiment panel similar to the embodiment of FIGS. 15 to 21, with like numbers used to indicate like parts, but with the addition of a prime (').

In the embodiment of FIGS. 23 to 27, the entire panel, including the topping layer, is pre-fabricated. The topping layer 49' is poured at the same time as the concrete anchors 47' and extends over the top of the end anchor 47'.

Figure 29:
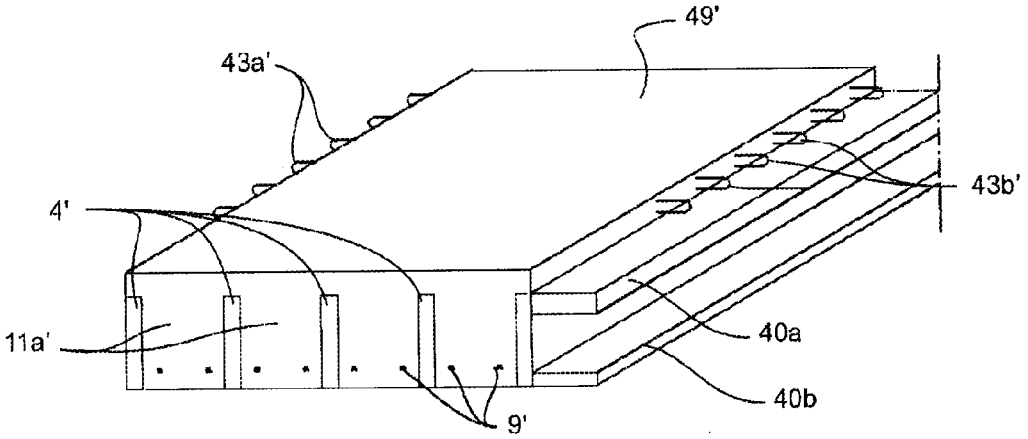
FIG. 29 is a partial front perspective view showing and end portion of a pre-stressed panel formed by the alternative form method of FIGS. 23 to 28.

The timber-based component 1' comprises a channel section 40 on one side, having a top flange 40*a* and a bottom flange 40*b*. The hooked ends 43*b*' at one end of the transverse reinforcing bars in the concrete topping layer protrude over the top flange 40*a*. A plurality of the beams shown in FIG. 29 can be placed side-by-side to form a larger panel.

In a similar manner as described above in relation to the embodiments of FIGS. 21 and 22, concrete can be poured into the spaces between topping layers on adjacent beams to embed the hooked ends 43*a*', 43*b*' of the reinforcing bars 43' in adjacent beams 1' and join the beams to form a continuous surface. The top flange 40*a* acts as formwork to support the joining concrete strip during this process.

The bottom flange 40*b* is cosmetic, to provide a flat surface if looking at the beam from below.

Alternative Cross Sections

The timber-based components 1, 101, 301 shown in FIGS. 1 to 22 are only exemplary embodiments. The timber-based component may take many alternative forms. FIGS. 30A to 30E give examples of pre-stressed panels having different cross-sections.

Figure 30A:
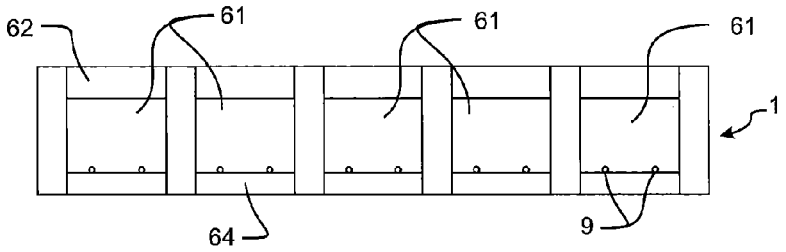
FIG. 30A is a sectional view showing one example of alternative form pre-stressed panels without a concrete topping layer.

As illustrated, the timber-based component 1 may comprise either hollows (FIGS. 30A, C, and D) or recesses (FIGS. 30B and E) to receive pre-stressing members 9. FIG. 30A shows a panel with a cassette-type cross section in which the anchors and pre-stressing members 9 are located in hollows 61 in the timber-based component 1.

Figure 30B:
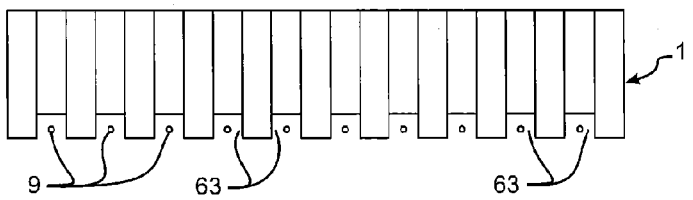
FIG. 30B is a sectional view showing another example of alternative form pre-stressed panels without a concrete topping layer.
Figure 30C:
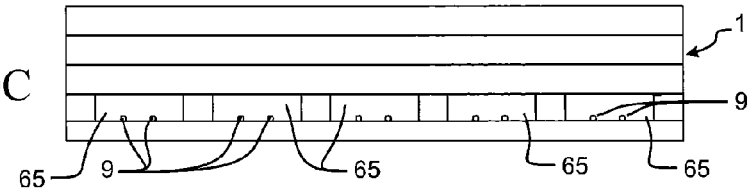
FIG. 30C is a sectional view showing another example of alternative form pre-stressed panels without a concrete topping layer.
Figure 30D:
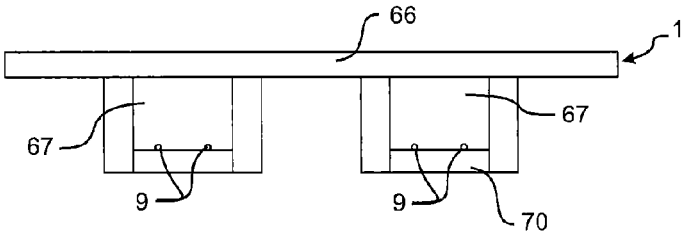
FIG. 30D is a sectional view showing another example of alternative form pre-stressed panels without a concrete topping layer.
Figure 30E:
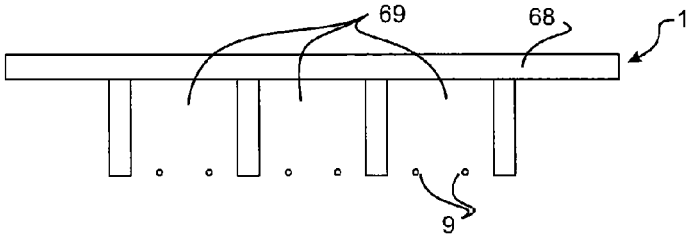
FIG. 30E is a sectional view showing another example of alternative form pre-stressed panels without a concrete topping layer.
Figure 31A:
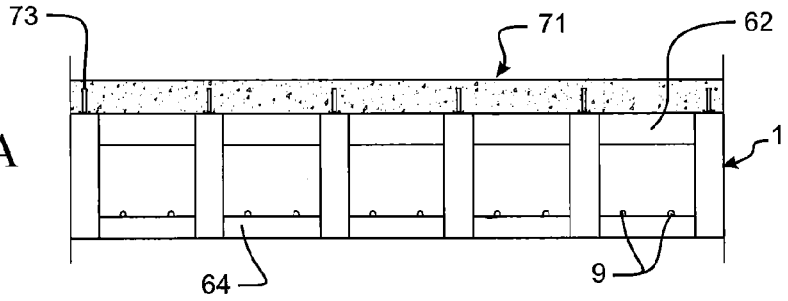
FIG. 31A is a sectional view showing one example of alternative form pre-stressed panels having a concrete topping layer.
Figure 31B:
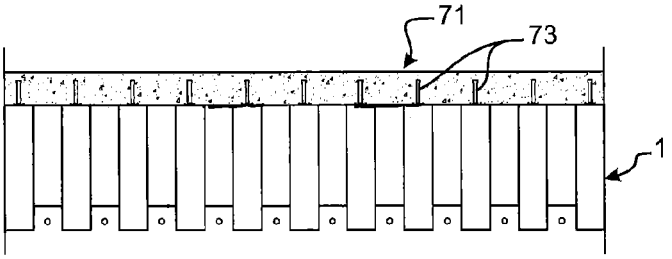
FIG. 31B is a sectional view showing another example of alternative form pre-stressed panels having a concrete topping layer.
Figure 31C:
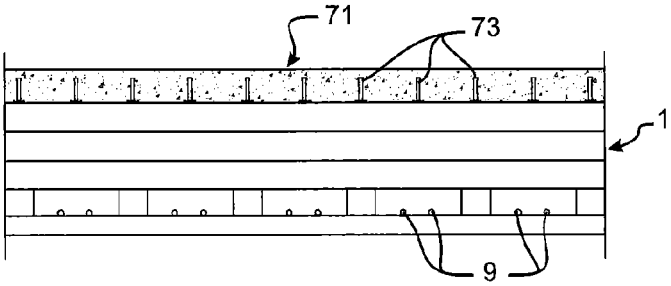
FIG. 31C is a sectional view showing another example of alternative form pre-stressed panels having a concrete topping layer.
Figure 31D:
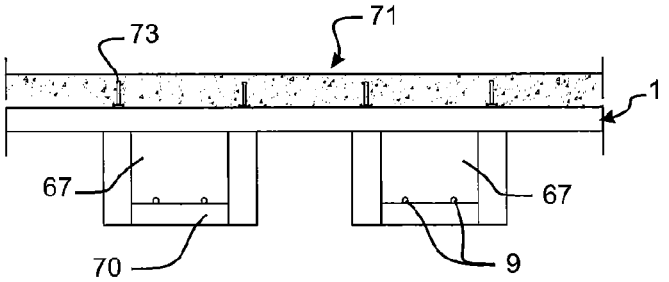
FIG. 31D is a sectional view showing another example of alternative form pre-stressed panels having a concrete topping layer.
Figure 31E:
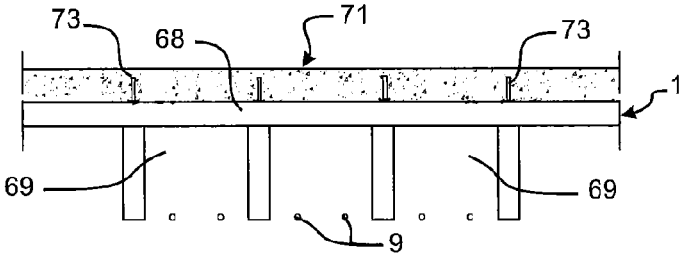
FIG. 31E is a sectional view showing another example of alternative form pre-stressed panels having a concrete topping layer.
Figure 32A:
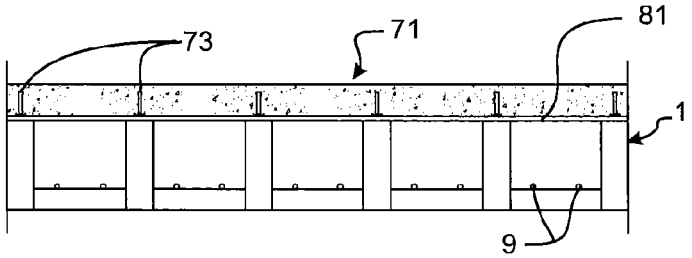
FIG. 32A is a sectional view showing one example of alternative form pre-stressed panels having a concrete topping layer.
Figure 32B:
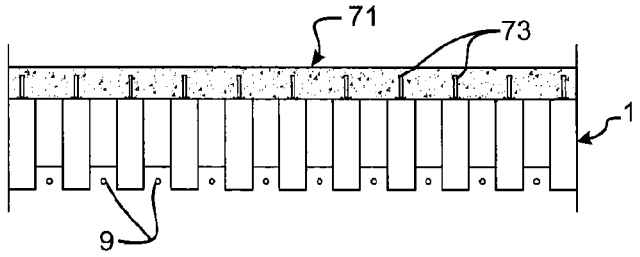
FIG. 32B is a sectional view showing another example of alternative form pre-stressed panels having a concrete topping layer.
Figure 32C:
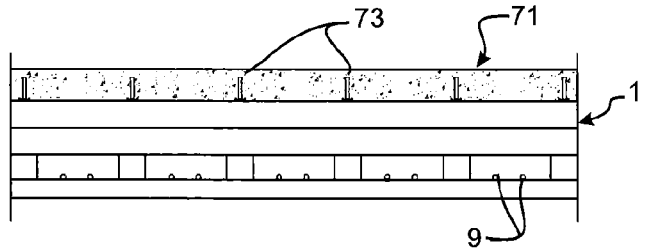
FIG. 32C is a sectional view showing another example of alternative form pre-stressed panels having a concrete topping layer.
Figure 32D:
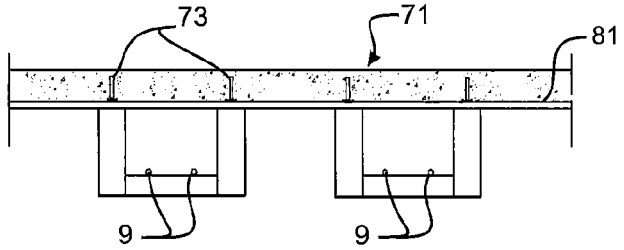
FIG. 32D is a sectional view showing another example of alternative form pre-stressed panels having a concrete topping layer.
Figure 32E:
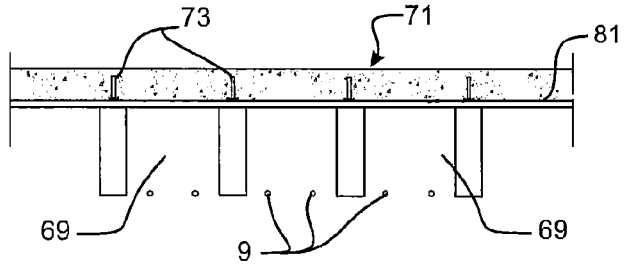
FIG. 32E is a sectional view showing another example of alternative form pre-stressed panels having a concrete topping layer.

FIGS. 30B and C show panels that are substantially solid, with either small hollows (FIG. 30C) or recesses (FIG. 30B) for the pre-stressing members 9 and anchors. In contrast, FIG. 30E shows a lighter-weight panel in which the timber-based component has a T-shaped cross section.

Aspects of the cassette-based, solid, and T-shaped cross-sections may be combined to produce any number of alternative cross-sections. For example the panel shown in FIG. 30D has a cross-section that is a combination of the cassette of FIG. 30A and the T-section of FIG. 30E.

Different cross-sections provide different advantages. For example, a T-section may be light weight, but a cassette-type or solid construction such as those in FIGS. 30A, B, and C would typically have higher fire resistance. It will be appreciated that many other cross-sections are possible.

Any of the panels shown in FIGS. 30A to 30E may additionally comprise a concrete-based topping layer. FIGS. 31A to 31E show sectional views of embodiments corresponding to those in 30A to 30E but that also comprise a concrete topping layer 71. In each embodiment in FIGS. 31A to 31E, the concrete topping layer 71, is connected to the timber-based component 1 by fasteners 73.

FIGS. 32A to 32E show sectional views of embodiments corresponding to those in 30A to 30E and 31A to 31E that also comprise a concrete topping layer 71, but with the upper timber flange 62 substituted with a thin plywood member 81. The plywood member 81 supports the weight of the concrete topping layer 71 when it is poured, but is not structural.

In embodiments having a concrete topping layer 71, the concrete topping layer 71 primarily resists compression, while the timber-based construction 1 resists tension and bending. The connection between the timber-based construction 1 and the concrete topping layer 71 transmits the shear forces between the two components. Advantages over timber floors include increased load-carrying capacity, higher stiffness (which leads to reductions in deflections and susceptibility to vibrations), improved acoustic and thermal properties, and higher fire resistance.

The exemplary timber-based components 1 illustrated in FIGS. 30A to 32E may comprise a combination of different engineered wood materials. The material selected will typically depend on the cross-section of the timber-based component, the final application for the beam or panel, and cost and manufacturing considerations.

As an example, the embodiments shown in FIGS. 30/31 A, D, and E may have top flanges 62, 66, 68 and bottom flanges 64, 70 made from laminated veneer lumber (LVL), and webs made from glued laminate timber, plywood, or LVL. Similarly, the timber-based component shown in FIGS. 30B, 31B, and 32B may comprise glued laminate or LVL. In contrast, the embodiment shown in FIGS. 30C, 31C, and 32C would preferably comprise cross-laminated timber. Many other combinations of timber-based materials are possible and would be apparent to a person skilled in the art.

In the embodiments shown, the tendons 9 are offset below the vertical mid-point of the beam or panel. This produces an upward deflection or pre-camber to balance deflection from downward loading on the beam or panel in use. For example, loading when the panels form a floor. Offsetting the pre-stressing members 9 to deflect the beam or panel towards the anticipated loading enables longer span beams or panels and/or shallower depth beams or panels when compared to an equivalent beam or panel with centrally positioned tendons.

A pre-stressed panel or beam produced using the above method is typically between 6 and 12 m long. However, shorter and longer beams and panels are possible. Longer lengths require increasing the depth and width of the panel or beam accordingly.

Bi-Directional Panels

Figure 33:
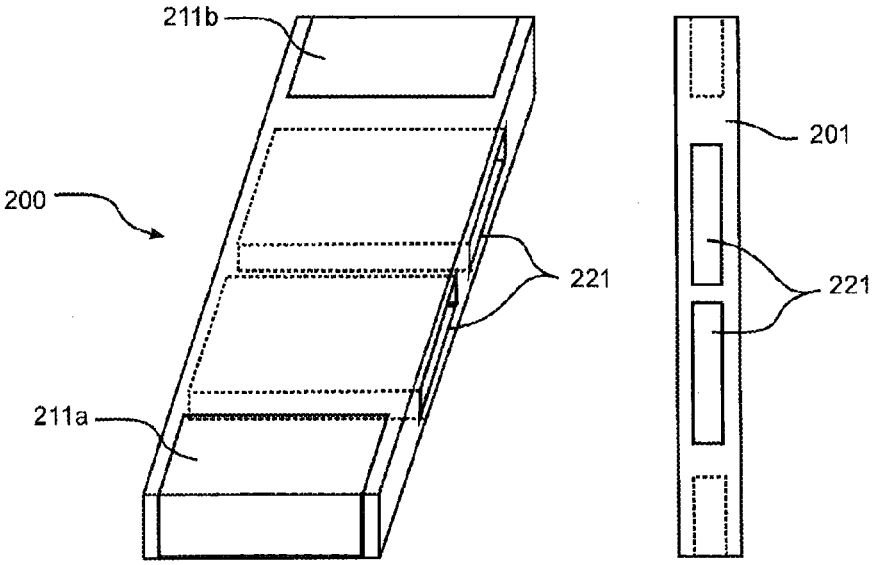
FIG. 33 schematically shows an alternative preferred form pre-stressed beam having transverse channels for receiving transverse pre-stressing members.
Figure 34:
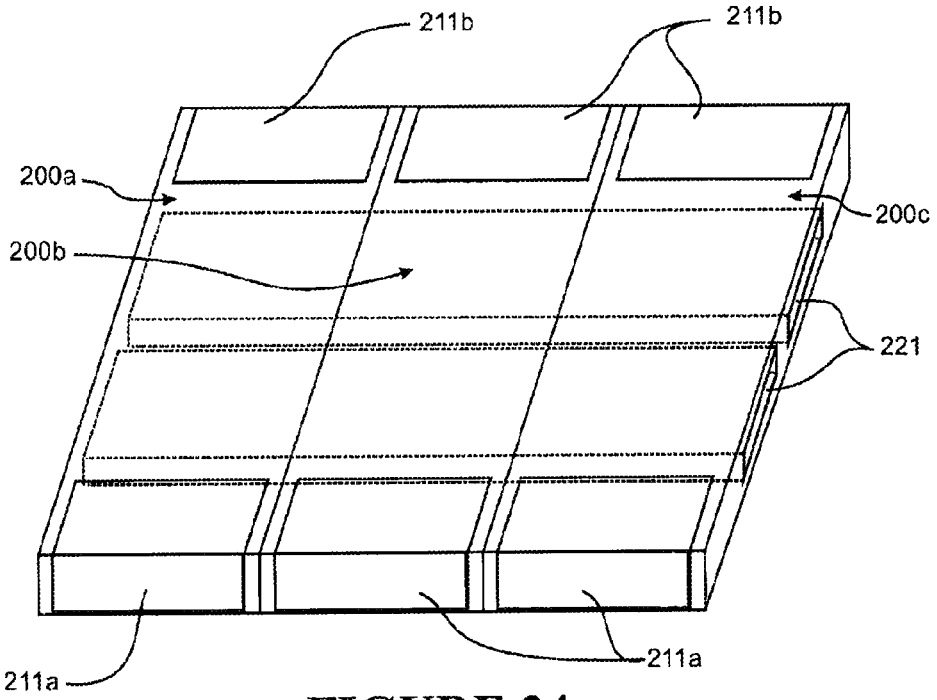
FIG. 34 shows a plurality of the pre-stressed beams of FIG. 33 arranged side-by-side for producing a panel that is pre-stressed in two directions.
Figure 35:
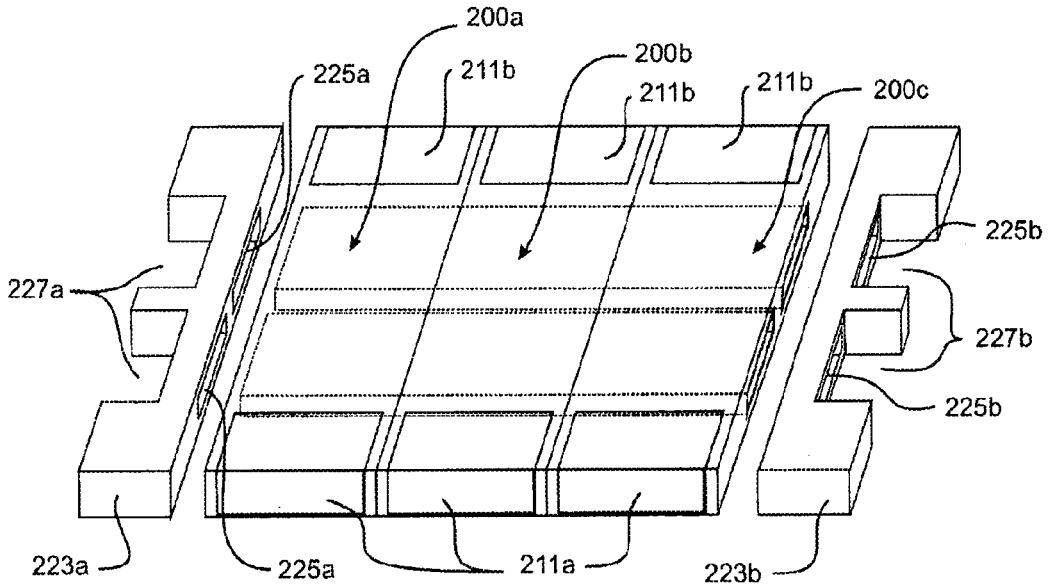
FIG. 35 shows side members placed on either side of the pre-stressed beam arrangement of FIG. 34 to contain the concrete for forming the side anchors.

FIG. 33 shows a further embodiment in which a pre-stressed beam 200 comprises a timber-based component 201 with plurality of transverse ports in the form of channels or hollow portions 221 spaced along its length. That beam 200 also comprises one or more longitudinal hollow portions that house elongate pre-stressing members (not shown). The pre-stressing members extend between concrete end anchors 211*a* and 211*b*, in the manner described above. The beam 200 may be produced by either of the preferred embodiment methods described above; i.e. either singularly or cut from a longer beam.

Timber-based components 201 with transverse ports, such as those shown in FIG. 33, may be placed side-by-side to produce a panel than can be stressed in a second, transverse direction. Such a panel may be pre-stressed in the second direction in the yard or factory at the same time as pre-stressing the beams in the first, longitudinal direction, to produce a pre-fabricated bi-directionally stressed panel. Alternatively the panel may be produced in two stages by first pre-fabricating beams or panels 200 in the factory, as described above, then arranging and post-tensioning the beams or panels 200 in the second direction on site. This alternative method is appropriate for larger panels where transport of the constructed panel would be prohibitive.

FIGS. 34 to 38 and FIGS. 39 to 42 illustrate a method for producing a bi-directionally stressed panel by arranging and post-tensioning a plurality of pre-fabricated pre-stressed beams 200.

Figure 38:
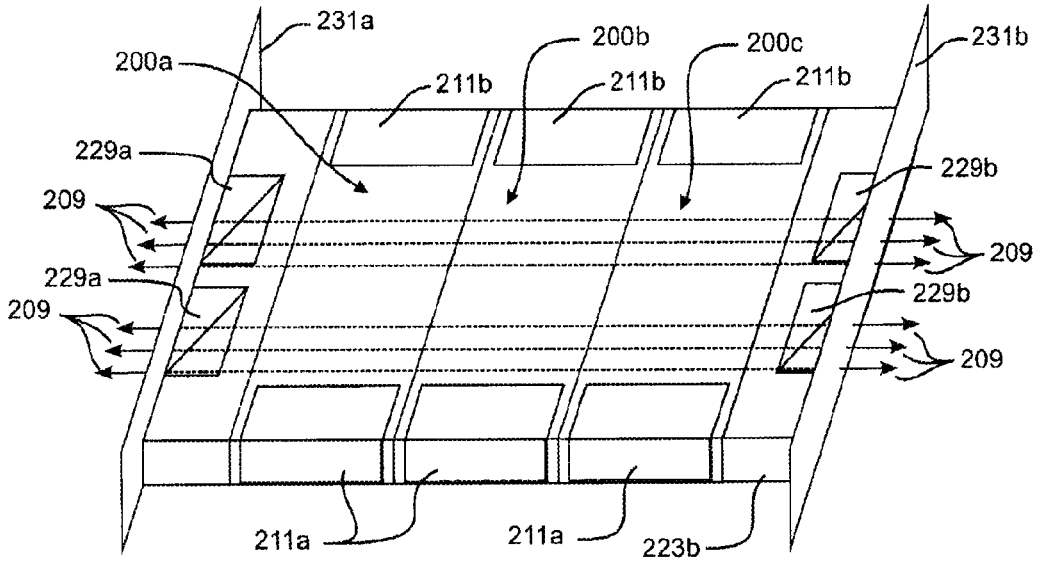
FIG. 38 corresponds to FIG. 37 and shows cutting planes for cutting the ends of the pre-stressing members protruding from the cured anchors.

In a first step shown in FIG. 38, a plurality of beams 200*a*, 200*b*, 200*c* are placed side-by-side so that the transverse ports 221 of the beams are aligned to form continuous channels or hollow portions. The beams 200*a*, 200*b*, 200*c* have been formed by one of the preferred embodiment methods described above. Side members 223*a*, 223*b* are then placed on either side of the multi-beam arrangement (see FIG. 35). The side members 223*a*, 223*b* have ports 225*a*, 225*b* that align with the ports 221 on the beams 200*a*, 200*b*, 200*c*. The aligned transverse ports 221 together define a plurality of transverse channels or hollow portions for receiving transverse post-stressing members. The side members 223*a*, 223*b* define open or boxed regions 227*a*, 227*b* on either side of the transverse hollow portions.

Figure 36:
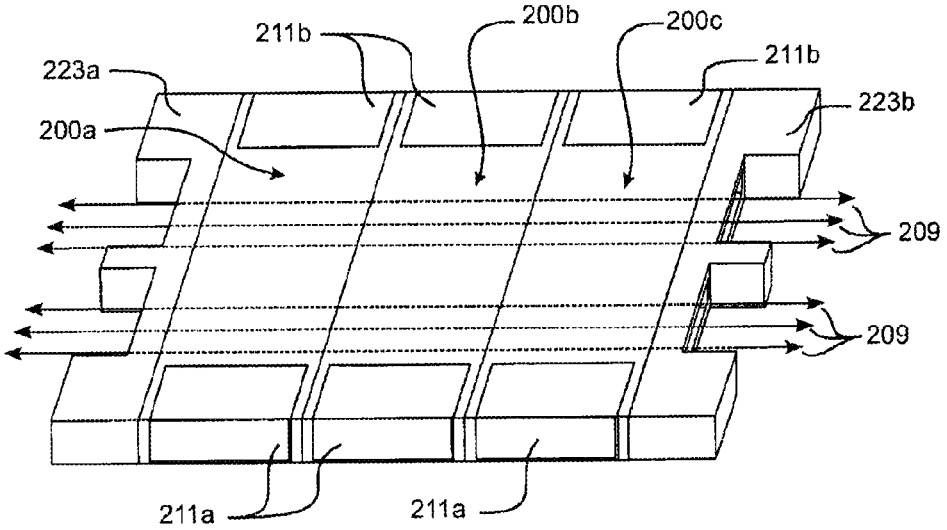
FIG. 36 corresponds to the arrangement of FIG. 35, schematically showing the transverse reinforcing members extending between the pre-stressed beams.
Figure 37:
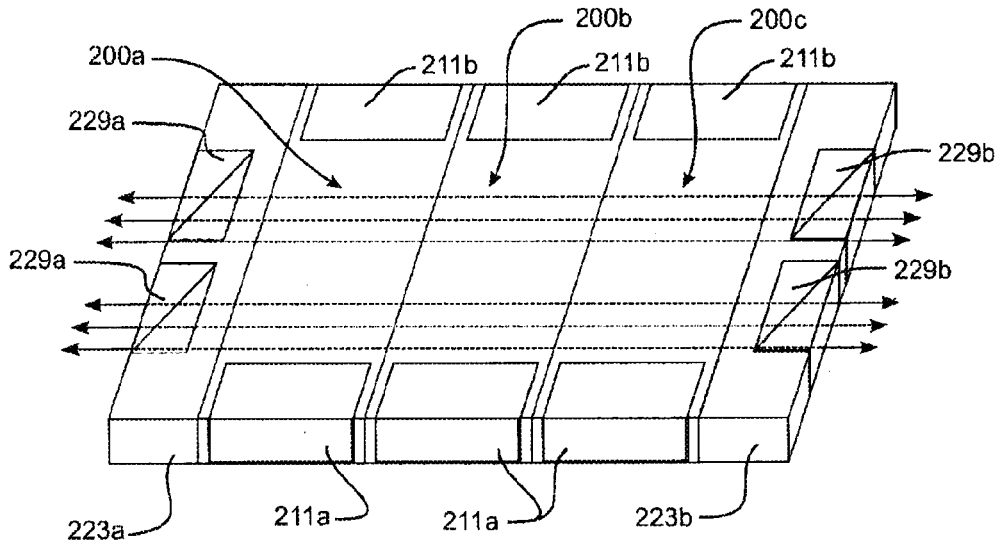
FIG. 37 corresponds to FIG. 36 and shows the concrete side anchors anchoring the transverse pre-stressing members.

After arranging the beams 200*a*, 200*b*, 200*c* and side members 223*a*, 223*b*, transverse tendons 209 are arranged in the transverse hollow portions, as shown in FIG. 36. The side members of the beams 200*a*, 200*b*, 200*c* should be sanded or otherwise prepared so that the side members of adjacent beams are flush. Alternatively, epoxy, grout or concrete may be injected or grouted between two adjacent beams 200*a*, 200*b*, 200*c*.

The tendons 209 are then tensioned using suitable tensioning machinery, for example hydraulic jacks. The tendons 209 are then kept in tension, for example by reacting the tensile force in the tendons against an anchor block or plate. The anchor block or plate may be positioned in or adjacent an end of the open anchor regions 229*a*, 229*b*, with the pre-stressing members 209 extending through apertures or notches in the block or plate. Alternatively the anchor block or plate may be externally fixed, for example anchored to the ground. The tendons are then fixed against the block or plate using any mechanical anchoring means, for example a thread and nut arrangement or a pre-stressing cone or wedge. In a third step shown in FIG. 37, while the tensioning force is maintained in the transverse tendons 209, concrete is poured into the open or boxed regions 227*a*, 227*b* embedding respective portions of the tendons 209 in the concrete. The concrete is then cured to form side anchors 229*a*, 229*b*. The concrete is typically cured to at least 70% of the nominal (28 day) compression strength of the concrete before the tension applied to the tendons 9 is released.

Alternatively, the concrete side anchors may be at least partially pre-cast, and the cables post-tensioned. The pre-cast anchors would be attached to the sides of the arranged pre-stressed beams of panels in a similar manner to the pre-cast anchors described above with respect to FIGS. 10 to 14. The transverse pre-stressing members 209 would then be placed through transverse channels or hollow portions and corresponding ducts in the attached pre-cast side anchors.

After the transverse pre-stressing members 209 are tensioned, they may be fastened to the pre-cast side anchors either by injecting concrete or grouting in the ducts and allowing that to cure, or by mechanically fastening the tensioned pre-stressing members to the anchors for example, by tightening a nut.

In a final step, the portions of the tendons 209 protruding from the sides of the side anchors are removed by cutting through the cutting planes 231*a*, 231*b* shown in FIG. 38.

This process forms a panel 233 that is pre-stressed in two directions. Such a panel may have application as a suspended floor, for example, where it is advantageous to transfer load in two directions. This arrangement would typically be suitable for covering long spans, as the panel can be lower depth than a beam that needs to span the same distance. Because the panels are either pre-tensioned prior to delivery to site, or only need to be post-tensioned in the transverse direction on site, not in both directions, this method significantly reduces the on-site labour required to construct a large bi-directionally stressed panel.

Figure 39:
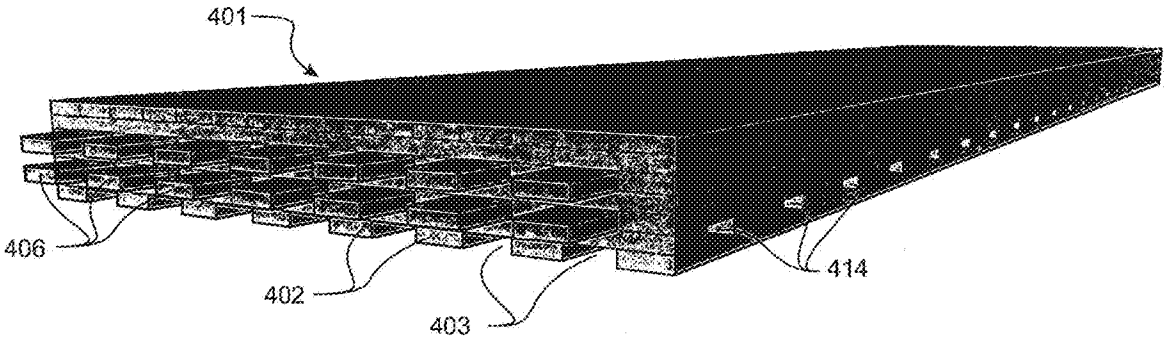
FIG. 39 is a perspective view of one embodiment timber-based component comprising cross-laminated timber and having transverse channels for receiving transverse pre-stressing members.
Figure 40:
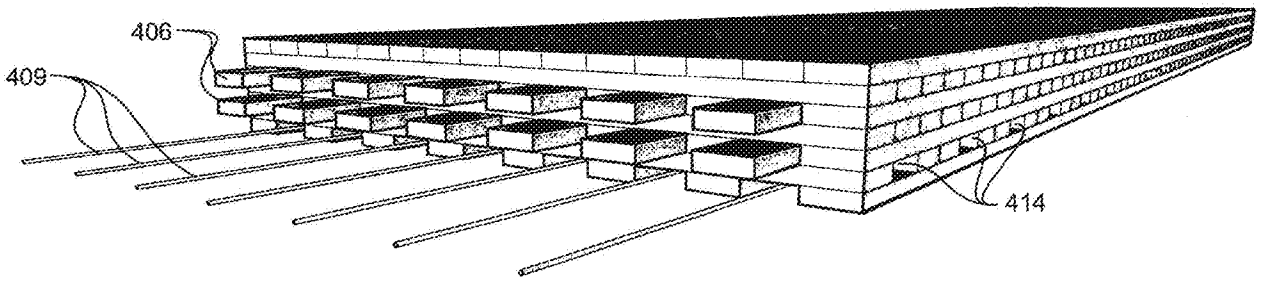
FIG. 40 is a perspective view showing the timber-based component of FIG. 39 with pre-stressing members arranged in the longitudinal channels.
Figure 41:
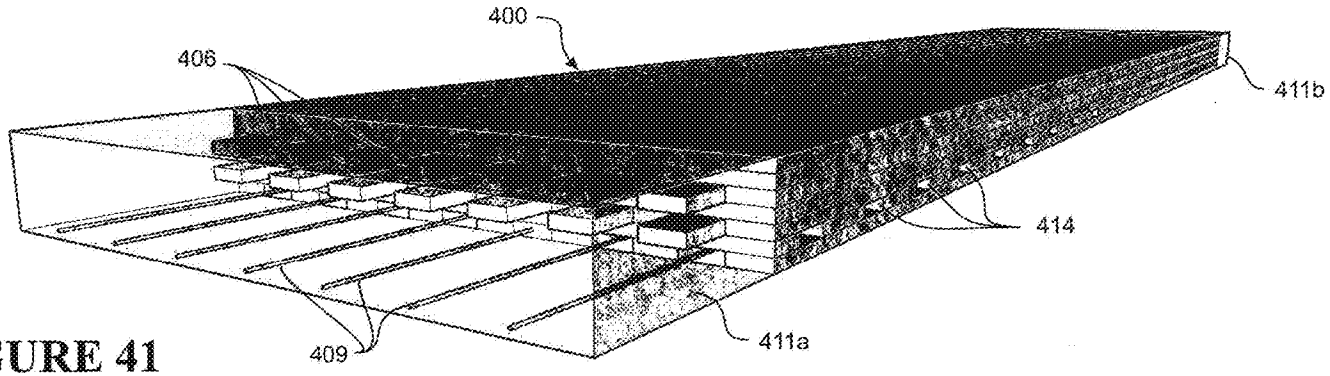
FIG. 41 is a perspective view corresponding to FIG. 40, showing the pre-stressing members embedded in concrete end anchors to pre-stress the beam.

FIGS. 39 to 41 illustrate a further embodiment timber component 401 (FIGS. 39 and 40) and pre-stressed beam 400 (FIG. 41) suitable for bi-directional pre-stressing. In that embodiment, the timber-based component 401 comprises cross-laminated timber with timber boards crossing in the longitudinal and transverse directions to make the timber-based construction 401 stronger in both directions. The timber based construction may comprise cavities to reduce weight, or may be substantially solid.

Cross-laminated timber is particularly suitable for bi-directional pre-stressing due to their bi-directional built-up. Cross-laminated timber provides relatively high in-plane and out-of-plane strength and stiffness in both directions, giving embodiments such as those shown in FIGS. 39 to 41 a two-way action capability to resist to pre-stressing forces.

Figure 42:
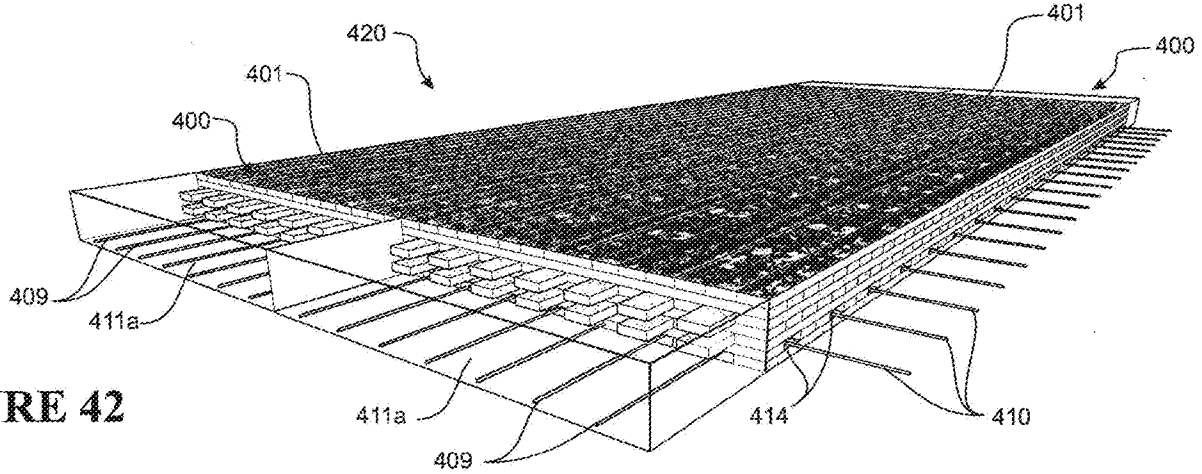
FIG. 42 is a perspective view showing two of the pre-stressed beams of FIG. 41 arranged side-by-side with transverse pre-stressing members arranged in the transverse channels of the timber-based component, for producing a panel that is pre-stressed in two directions.

The pre-stressed beams of FIG. 41 may be used to build bi-directional pre-stressed panels in the same manner explained above in relation to FIGS. 33 to 38 and as illustrated in FIG. 42. The timber based component has transverse channels 414 for receiving transverse pre-stressing members 410 (FIG. 42). The ends of the transverse pre-stressing tendons 410 may be anchored by tensioning the tendons and pouring side anchors to anchor the tendons, or using mechanical anchors on site.

The timber component of FIGS. 39 to 41 also comprises timber shear keys 406 that protrude in a longitudinal direction into the end anchor regions. The timber shear keys 406 become embedded in the end anchors when the concrete is poured and assist in transferring vertical shear forces from the timber-based component 401 to the respective concrete anchor 411*a*, 411*b*.

Anchors

Force from the pre-stressing members may be transferred from the concrete anchors to the timber-based component as a predominantly compressive or shear force, or as a combination of compressive and shear forces. The end anchor regions and any intermediate anchor regions on the timber-based component 1, 101, 201 may comprise features to enhance the shear or axial connection between the timber-based component 1 and the concrete anchors 11*a*, 11*b*, 13, 18*a*, 18*b*, 111*a*, 111*b*, 211*a*, 211*b*. FIGS. 43A to 43D, 44, 45, 46A to 46C, and 17A to 17D show examples of features to improve the shear connection between the concrete anchor and the timber-based component.

Figure 43A:
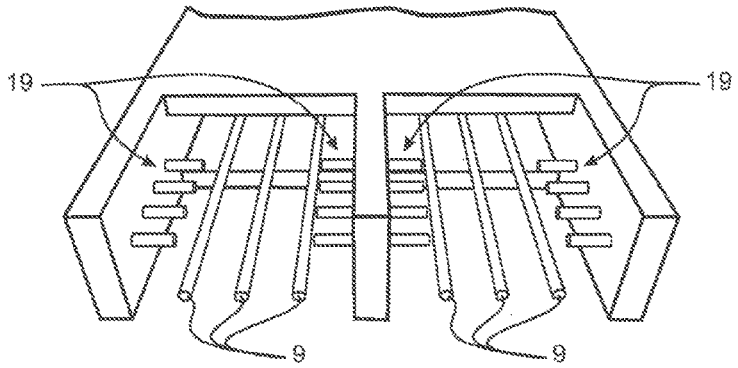
FIG. 43A shows exemplary features for strengthening the connection between the concrete anchors and the timber-based component, where
Figure 43B:
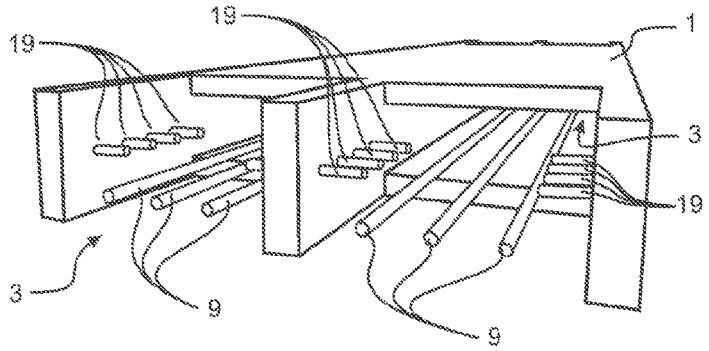
FIG. 43B shows exemplary features for strengthening the connection between the concrete anchors and the timber-based component, where
Figure 43C:
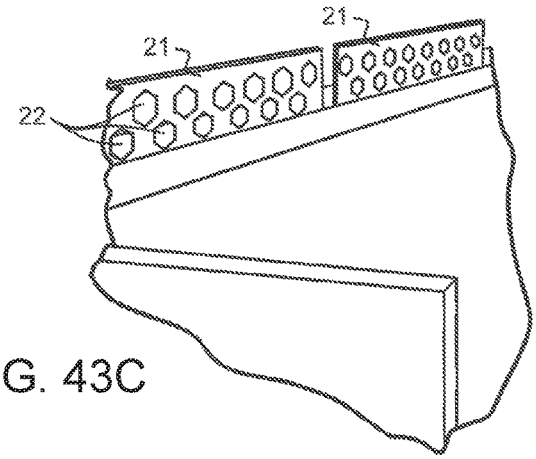
FIG. 43C shows exemplary features for strengthening the connection between the concrete anchors and the timber-based component, where

FIGS. 43A and 43B show end anchor cavities 5*a* at one end of the timber-based component of FIGS. 1A to 5, with pre-stressing tendons 9 arranged in the hollow portions 3, and having shear connectors 19. In the form shown, the shear connectors comprise a plurality of screws or rods 19 projecting from side walls and a middle wall of the timber-based component 1 into the anchor region 5*a*. The rods are fastened to the walls. When the concrete is poured into the anchor region the concrete envelops the projecting rods 19. The concrete then cures, embedding the rods 19. The embedded rods strengthen the connection between the concrete anchors 11*a* and the timber-based component 1 to prevent longitudinal movement of the anchor relative to the timber-based component.

Figure 43D:
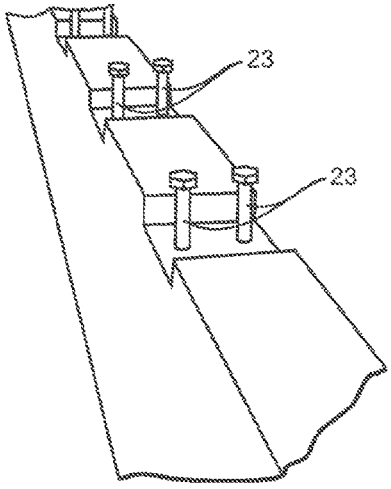
FIG. 43D shows exemplary features for strengthening the connection between the concrete anchors and the timber-based component, where

Instead of rods 19, other features may be provided to improve the shear connection between the concrete anchors 11*a*, 11*b*, 13, 18*a*, 18*b*, 111*a*, 111*b*, 211*a*, 211*b* and the timber-based component 1. For example, one or more plate members 21 such as those shown in FIG. 43C may be provided in the anchor regions. The plate members 21 would project into the anchor region and comprise apertures 22 which the poured concrete fills to connect the plate 21 to the anchor. As a further example, screws or bolts 23 may be arranged to protrude from the timber-based component in a similar manner to the rods 19, as shown in FIG. 43D.

Figure 44:
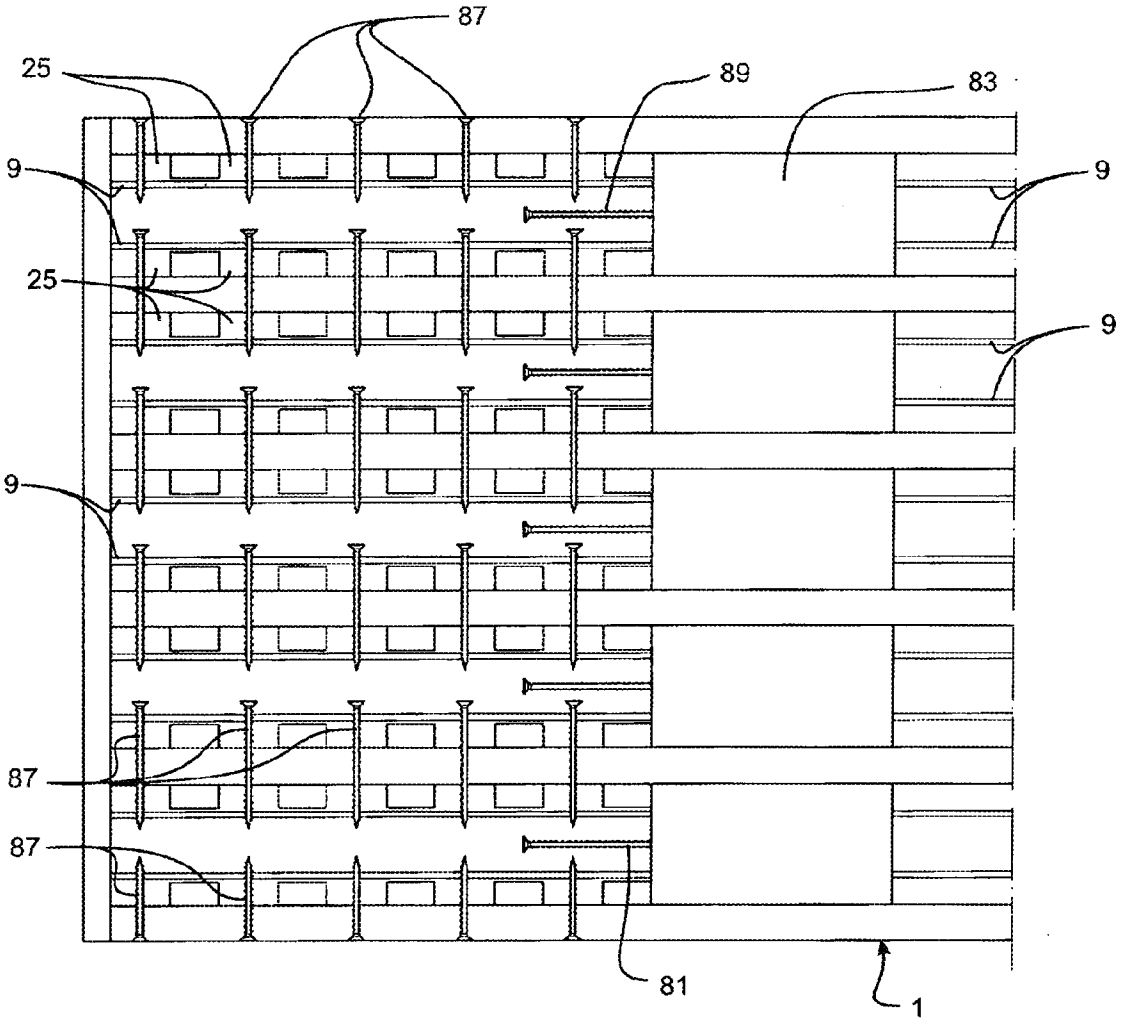
FIG. 44 is a partial plan view showing an embodiment of the timber-based component having recesses and screws or rods in the side walls in the anchor region to transfer the pre-stressing force from the anchor to the timber-based component predominantly by shear forces.

In another embodiment, one or more of the side walls or top or bottom walls of the timber-based component in the anchor regions may be provided with undulations, projections or recesses, to provide an uneven surface to interface with the concrete and enhance the shear connection. FIG. 44 shows an example of an embodiment in which the timber-based component comprises a plurality of side recesses 25 in walls of the component in the anchor regions, and protruding screws 87, 89 to enhance the shear connection between the timber-based component and the concrete anchor.

Figure 45:
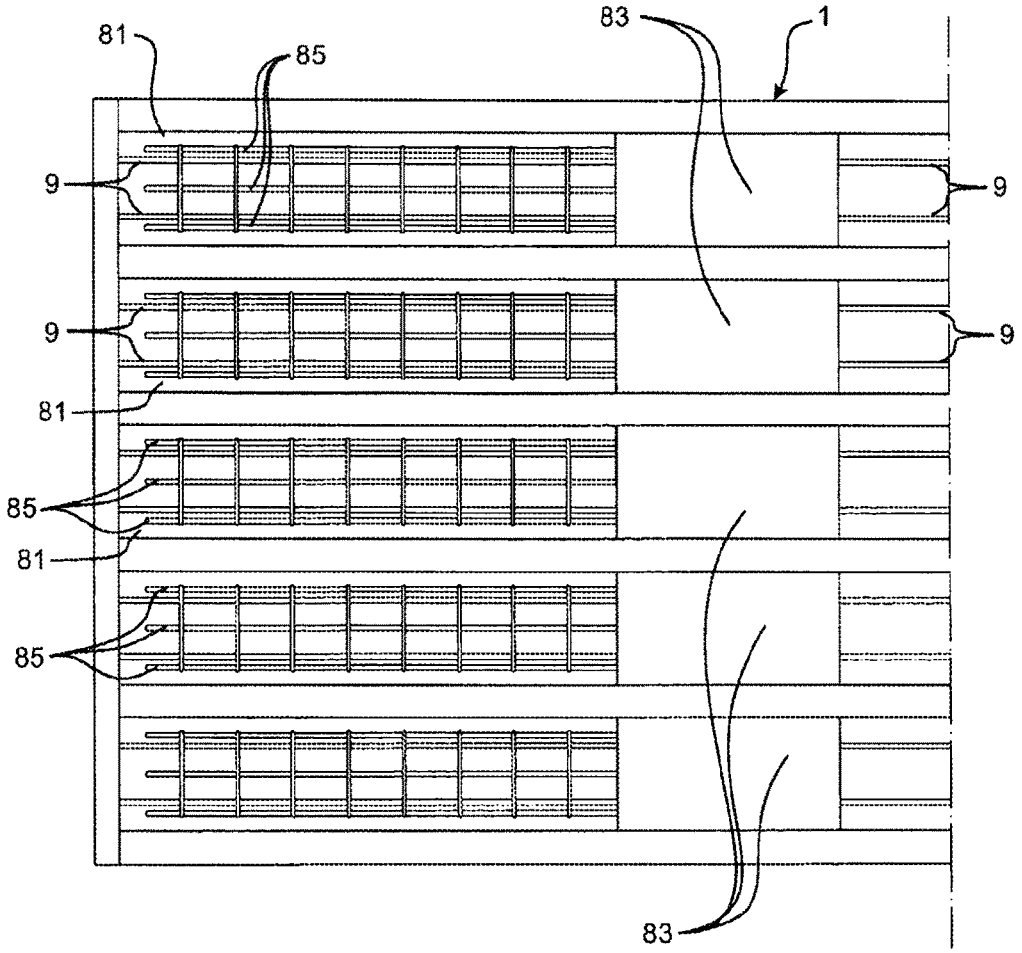
FIG. 45 is a partial plan view showing an arrangement of connecting rods and pre-stressing members in an embodiment where the pre-stressing force is transferred from the anchor to the timber-based component predominantly by compression.

FIG. 45 shows an embodiment in which the pre-stressing force is applied to the timber-based component 1 by way of compression. In that embodiment, the pre-stressing force is axially applied to the timber-based block 83 at the end of the anchor 71. Screws or rods 85 extend from the timber block 83 into the concrete anchor 81 to enhance the connection and the force transfer between the anchor 81 and the timber block 83. The screws or rods 85 take the bending moments and shear forces induced by external loading on the beam or panel.

The pre-stressed beams or panels may comprise longitudinal reinforcing. FIGS. 46A to 47D show two embodiment beams having steel reinforcing 512, 612 and shear connectors 506, 606 in the anchor region. The longitudinal reinforcing 512, 612 preferably comprises conventional reinforcing steel bars, as commonly used for concrete structures. Reinforcing bars are placed at or towards the top of the timber based construction 501, 601 and prevent a gap opening between the concrete and the timber construction 501, 601 when only pre-stressing is applied. The reinforcing bars 512, 516 may be epoxied into the timber-based construction 501, 601.

The embodiment shown in FIGS. 47A to 47D additionally comprises reinforcing members 612 at or towards the bottom of the timber-based construction 601 to provide both moment capacity in the concrete-to-timber transition area and shear strength to vertical loading.

Figure 46A:
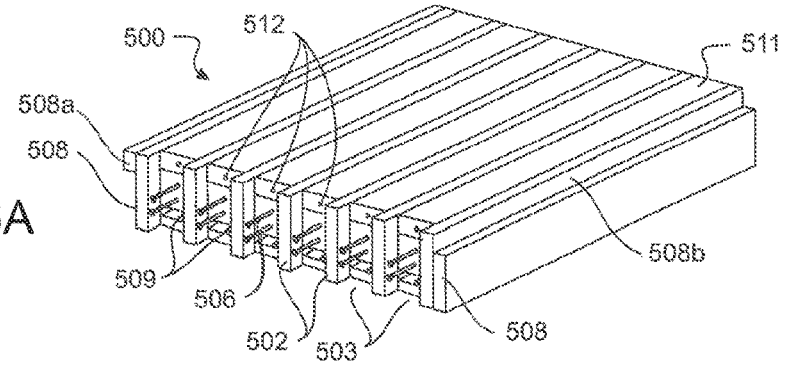
FIG. 46A shows an end anchor in a further embodiment pre-stressed beam or panel having steel reinforcing and shear bolts in the anchor region, where
Figure 46B:
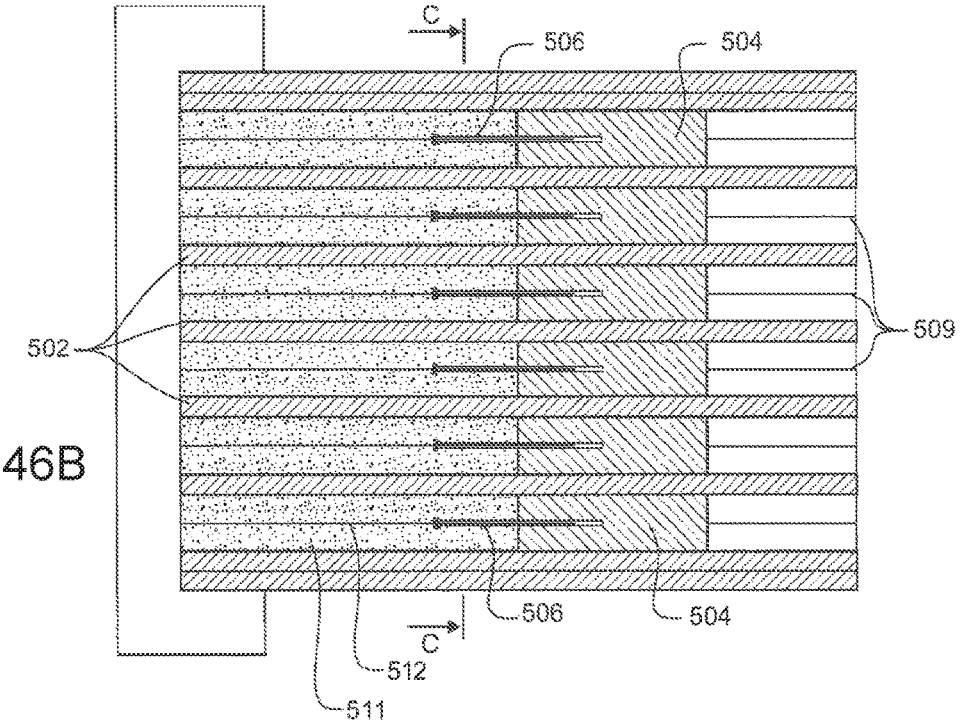
FIG. 46B shows an end anchor in a further embodiment pre-stressed beam or panel having steel reinforcing and shear bolts in the anchor region, where
Figure 46C:
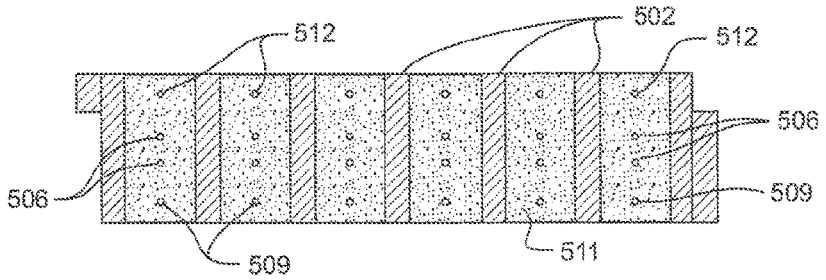
FIG. 46C shows an end anchor in a further embodiment pre-stressed beam or panel having steel reinforcing and shear bolts in the anchor region, where

In the embodiment of FIGS. 46A to 46C, shear bolts 512 extend longitudinally into the anchor region. The shear bolts 512 take the shear forces from the timber-based construction 501 to the concrete anchor 511.

The timber construction 501 comprises one side timber web 508 with a top lip 508*a*, and one side timber web 508 with a complementary recess 508*b*. This enables shear force to be taken by the timber webs 508 when beams 500 are placed side-by-side, without the need to connect the webs using bolts.

The force from the pre-stressing tendons 509, 609 is transferred from the concrete anchor 511, 611 to the timber-based component 501, 601 as a combination of compressive and shear forces. The compressive pre-stressing is transferred to the timber deviators 504, 604 defining the end of the anchor 511, 611. Shear stress is transferred at the interface between the timber-based component and concrete by the timber webs 502, 602 between pre-stressing members 509, 609 and the shear connectors 506, 606 and reinforcing bars 512, 612.

Figure 47A:
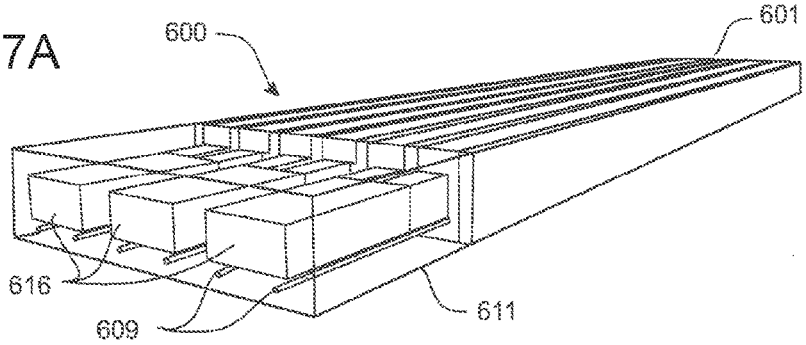
FIG. 47A shows an end anchor in a further embodiment pre-stressed beam or panel having timber shear keys and polystyrene blocks in the anchor region, where
Figure 47B:
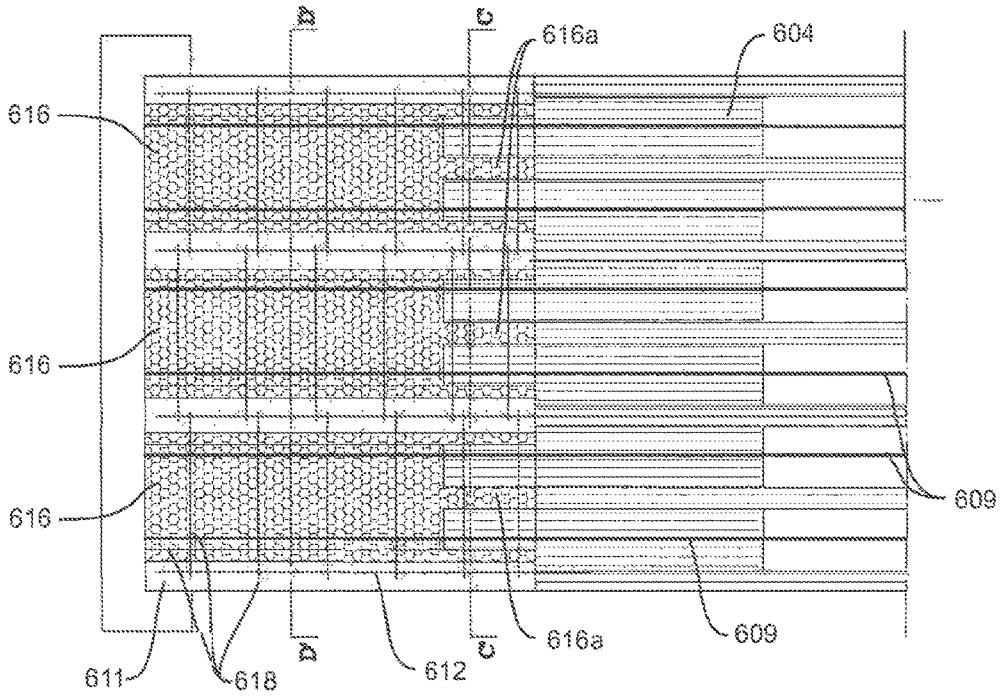
FIG. 47B shows an end anchor in a further embodiment pre-stressed beam or panel having timber shear keys and polystyrene blocks in the anchor region, where
Figure 47C:
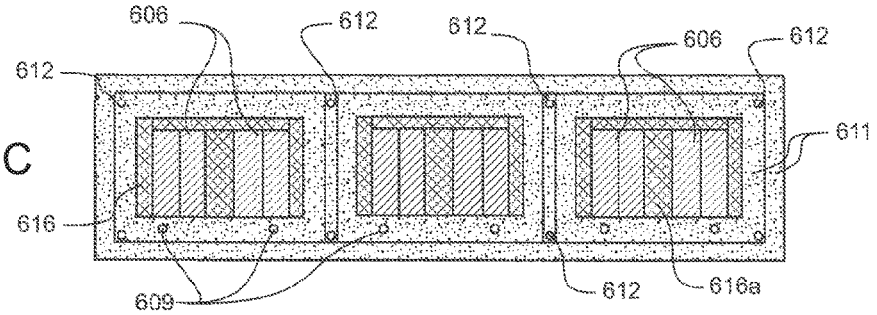
FIG. 47C shows an end anchor in a further embodiment pre-stressed beam or panel having timber shear keys and polystyrene blocks in the anchor region, where
Figure 47D:
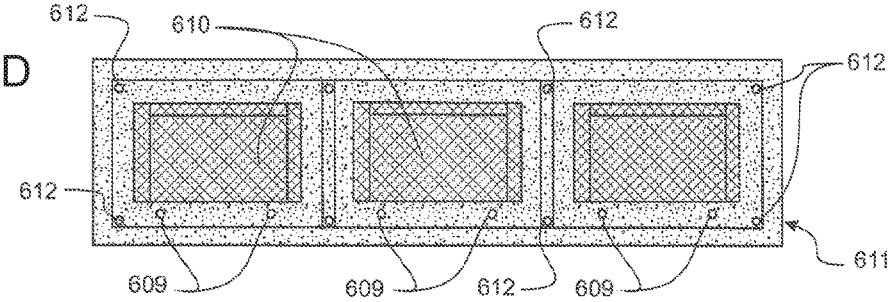
FIG. 47D shows an end anchor in a further embodiment pre-stressed beam or panel having timber shear keys and polystyrene blocks in the anchor region, where

The beam embodiment shown in FIGS. 47A to 47D comprises timber shear keys 606 that protrude in the longitudinal direction, into the anchor region 611 to enhance the connection between the timber-based component 3 and the concrete anchor 3. As best illustrated in FIG. 47B, one timber key 606 is positioned above each pre-stressing tendon 609. However, alternatively there may be more or fewer timber keys 606.

In the embodiment shown in FIGS. 47A to 47D, the pre-stressing force is transferred to the timber component 601 mainly as a compressive force. The concrete anchor 611 pushes directly against the webs and flanges of the timber construction 601, which absorb all the pre-stressing force. The timber shear keys 606 together with the longitudinal reinforcing bars 612 provide the shear capacity at the interface.

The anchor regions further comprise transverse stirrups 618 (FIG. 47B) made of conventional reinforcing steel. The stirrups 618 take the vertical shear induced by the gravity load in the concrete anchor 611.

To reduce the total weight of the pre-stressed beams or panels, polystyrene blocks 616 are embedded in the concrete anchor 611 and attached, for example glued, to the timber shear keys 606. Each polystyrene block 616 has two recesses that receive two respective adjacent timber keys such that polystyrene surrounds three sides of each timber key 606, with a web 616*a* of the polystyrene block 616 extending between two adjacent timber keys 606. The embodiment shown comprises six pre-stressing tendons, six timber shear keys 606 and three spaced apart polystyrene blocks 616. To form the anchor 611, concrete is poured into a boxed anchor region, embedding the polystyrene blocks 616 pre-stressing tendons 609, and reinforcing members 612.

Preferred embodiments of the invention have been described by way of example only and modifications may be made thereto without departing from the scope of the invention. For example, rather than providing central hollow chambers in the timber-based component for receiving reinforcing members, the timber-based component may comprise one or more open channels along one or more of the sides of the component. For example, a plurality of channels may be provided on the top and bottom surfaces of the timber-based component.

The features in any of the above described embodiments can be combined or replaced by features from other embodiments without departing from the scope of the invention. The dimensions, numbers of components, and described arrangements described for the preferred embodiments are by way of example only. For example, rather than each sub-beam 14*a*, 14*b*, 14*c* being the same length, the concrete anchors 13 could be spaced unevenly so as to form sub-beams of lengths that differ from each other. Typically, longer beams or sub-beams would require a greater beam depth than shorter beams or sub-beams.

As another example, while the embodiment of FIGS. 1A to 5 is described as having three sub-beams 14*a*, 14*b*, 14*c*, the beam could instead have two, four, or more sub-beams, by varying the number of intermediate anchors 13 and cuts. If long pre-stressing equipment is used (say 200 m length) if would be possible to pre-stress, say, twenty sub-beams. Similarly, for the bi-directional embodiment, twenty panels could be pre-stressed in a single stage.

As another example, the timber-based components could have one, two, three, or more pre-stressing members positioned in each hollow.

Other modifications are outlined in the 'summary of the invention' section.

The above described preferred embodiment pre-stressed timber-based beams and panels provide a high strength to weight ratio in comparison to other commonly used alternatives such as reinforced concrete. This enables longer span floors for architectural design purposes, reduces the cost of supporting beams, columns and foundations (due to lowered strength requirements), and reduces the cost of transport and lifting of the beams or panels and their supporting structures. A manufacturer is also able to supply a larger geographic region due to lower transport costs. The lower weight of the preferred embodiment timber-based beams and panels also means that in a seismic event, less energy is transferred through inertia to the supporting structures, resulting in less damage.

By being pre-fabricated, the preferred embodiment beams and panels are also more accessible to end users, meaning builders and other users are more likely to readily adopt the beams and panels. The preferred embodiment timber-based beams and panels also have a lower carbon footprint than many other construction materials such as concrete-based beams and other commercial flooring alternatives. This means the above described beams and panels may be an attractive option in 'green building' projects.

The invention claimed is:

1. A method of manufacturing a pre-stressed, pre-tensioned beam or panel comprising:

providing a timber-based component;

providing a pre-stressing member arranged along the timber-based component;

applying a tensile force to the pre-stressing member;

pouring concrete at locations that are spaced apart along the timber-based component and the pre-stressing member, to embed respective portions of the pre-stressing member in the concrete;

allowing the concrete to substantially cure, thereby bonding the pre-stressing member to the concrete to form discrete concrete anchors; and releasing the tensile force on the pre-stressing member to transfer a compressive force to the timber-based component through the concrete anchors to form the pre-stressed beam or panel.

2. The method according to claim 1, wherein the concrete is poured at two spaced apart locations positioned at or adjacent ends of the timber-based component such that the discrete concrete anchors are end anchors.

3. The method according to claim 1, wherein the concrete for the anchors is poured into hollows or boxed regions defined by the timber-based component.

4. The method according to claim 1, wherein shear or axial connectors protrude from the timber-based component into one or more of the anchor locations and become at least partly embedded in the respective concrete anchor when the concrete is poured.

5. The method according to claim 1, comprising placing timber, polystyrene or other filler material at the location for each anchor, before pouring the concrete, to create a light-weight core, region, or void in the anchors.

6. The method according to claim 1, comprising placing one or more steel reinforcing members at the location for each anchor, before pouring the concrete, to reinforce the concrete anchors.

7. The method according to claim 1, comprising providing and tensioning a plurality of the pre-stressing members.

8. The method according to claim 1, wherein the pre-stressing member comprises a rod, bar or cable.

9. The method according to claim 1, wherein the timber-based component comprises an elongate hollow portion or channel that receives at least a portion of the pre-stressing member.

10. The method according to claim 9, wherein the pre-stressing member is inserted in the hollow portion or channel during assembly of the timber-based component such that at least a part of the pre-stressing member is enclosed by the timber-based component.

11. The method according to claim 1, wherein the timber-based component comprises one or more of: an engineered timber laminate, a wood-based composite, and sawn hard wood.

12. The method according to claim 1, wherein the timber-based component further comprises steel, carbon fibre, or glass reinforcing.

13. The method according to claim 1, further comprising the step of pouring a concrete topping layer on a top side of the timber-based component.

14. The method according to claim 1, wherein the timber-based component further comprises a transverse channel or hollow portion for receiving a transverse pre-stressing member, the transverse channel or hollow portion extending in a transverse direction.

15. The method according to claim 14, wherein the timber-based component comprises cross laminated timber.

16. The method according to claim 14, comprising the steps of:

inserting a transverse pre-stressing member into the transverse channel or hollow portion;

applying a tensile force to the transverse pre-stressing member;

pouring concrete at spaced apart locations along the transverse pre-stressing member;

allowing the concrete to substantially cure to anchor respective portions of the transverse pre-stressing member; and releasing the tension from the transverse pre-stressing member to pre-stress the beam or panel in the transverse direction.

17. The method according to claim 1, wherein the step of providing the pre-stressing member comprises offsetting the pre-stressing member below a vertical mid-point of the beam or panel.

18. A pre-fabricated pre-stressed, pre-tensioned beam or panel comprising:

a timber-based component;

spaced apart concrete anchors operatively connected to the timber-based component, the concrete anchors comprising hollow regions or timer cores; and a pre-stressing member extending between the spaced apart concrete anchors;

wherein the pre-stressing member comprises anchored portions embedded in and bonded to the concrete anchors to apply a compressive force to the timber-based component to pre-stress the beam or panel.

19. The beam or panel of claim 18, wherein the timber-based component is an elongate member comprising an elongate hollow portion or channel containing at least a portion of the pre-stressing member.

20. The beam or panel of claim 18, wherein a cross sectional area of each concrete anchor is much larger than a cross sectional area of a hollow portion or channel at a location at or adjacent each anchor.

21. The beam or panel of claim 18, wherein the timber-based component comprises one or more of: an engineered timber laminate, a wood-based composite, and sawn hard wood.

22. The beam or panel of claim 18, comprising a concrete topping layer on a top side of the timber-based component.

23. The beam or panel of claim 18, comprising a plurality of the pre-stressing members.

24. The beam or panel of claim 18, wherein the timber-based component comprises a transverse channel or hollow for receipt of a transverse pre-stressing member.

25. The beam or panel of claim 18, comprising at least one of shear connectors and axial connectors that protrude from the timber-based component into one or more of the anchor regions, such that the connectors are at least partly embedded in the concrete anchors.

26. The beam or panel of claim 25, wherein the connectors comprise timber-based protrusions on the timber based component.

27. The beam or panel of claim 18, wherein the timber-based component comprises recesses in the anchor regions, and wherein the concrete anchors protrude into the recesses.

28. The beam or panel of claim 18, comprising:

a plurality of the timber-based components positioned side-by-side;

discrete spaced apart transverse concrete anchors; and a transverse pre-stressing member extending between the transverse concrete anchors in a transverse direction and coupled to the transverse concrete anchors, the transverse pre-stressing member applying a compressive force to the timber-based component to pre-stress the beam or panel in the transverse direction.

29. The beam or panel of claim 18, wherein the pre-stressing member is offset below a vertical mid-point of the beam or panel.

* * * * *